US006304238B1

(12) United States Patent
Tsuchida

(10) Patent No.: US 6,304,238 B1
(45) Date of Patent: Oct. 16, 2001

(54) DRIVING APPARATUS FOR PLASMA ADDRESSED LIQUID CRYSTAL DISPLAY APPARATUS

(75) Inventor: Susumu Tsuchida, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/382,095

(22) Filed: Aug. 24, 1999

(30) Foreign Application Priority Data

Aug. 25, 1998 (JP) ..... 10-239009

(51) Int. Cl.[7] ..... G09G 3/36
(52) U.S. Cl. ..... 345/87; 94/96; 94/63
(58) Field of Search ..... 345/87, 94, 95, 345/96, 98, 147, 60, 63

(56) References Cited

U.S. PATENT DOCUMENTS 4,733,105 * 3/1988 Shin et al. ..... 307/261
5,498,932 * 3/1996 Shin et al. ..... 315/169.3
5,708,453 * 1/1998 Tsuchida et al. ..... 345/87
5,784,041 7/1998 Okada et al. ..... 345/89
6,111,559 * 8/2000 Motomura et al. ..... 345/102

FOREIGN PATENT DOCUMENTS 0642112 3/1995 (EP) ..... G09G/3/36
0730257 9/1996 (EP) ..... G09G/3/36

* cited by examiner

*Primary Examiner*—Bipin Shalwala
*Assistant Examiner*—Jimmy H. Nguyen
(74) *Attorney, Agent, or Firm*—Jay H. Maioli

(57) ABSTRACT

A driving apparatus for a plasma addressed liquid crystal display has a reference voltage selection D/A converter (27) for applying a driving voltage to a first transparent scanning electrode group, a common anode inversion driving voltage generator (30) for applying a common anode inversion driving voltage obtained by relatively inverting a driving voltage to a second electrode scanning electrode group, and a contrast reduction adjustor (42) for simultaneously tracking a voltage on a low voltage side when a reference voltage is not inverted in the reference voltage selection D/A converter (27) and a power-supply voltage on a high-voltage side at the time of inversion, and adjusting the voltages so as to adjust reduction in contrast.

1 Claim, 20 Drawing Sheets

FIG. 7B

| | | | | | |
|---|---|---|---|---|---|
| − | + | − | + | − | + |
| − | + | − | + | − | + |
| − | + | − | + | − | + |
| − | + | − | + | − | + |
| − | + | − | + | − | + |
| − | + | − | + | − | + |
| − | + | − | + | − | + |
| − | + | − | + | − | + |

Next Field

FIG. 7A

| | | | | | |
|---|---|---|---|---|---|
| + | − | + | − | + | − |
| + | − | + | − | + | − |
| + | − | + | − | + | − |
| + | − | + | − | + | − |
| + | − | + | − | + | − |
| + | − | + | − | + | − |
| + | − | + | − | + | − |
| + | − | + | − | + | − |

First Field

FIG. 9A Image Output Data Which Was Subject to D/A Conversion

FIG. 9B Gate Voltage of NMOS Transistor on The 1st Line

FIG. 9C Cathode Waveform on The 1st Line

FIG. 9D Gate Voltage of NMOS Transistor on The 2nd Line

FIG. 9E Cathode Waveform on The 2nd Line $$Vo=\frac{(n+1)[VREF(m+1)-VREF]}{16}+VREFm$$

| | | | | |
|---|---|---|---|---|
| (a) | High-Order 3 Bits | 110b Data | SW6 On | VREF7 → VHIGH<br>VREF6 → VLOW<br>Selection |
| (b) | Low-Order 4 Bits | 1001b Data | SL9 On | $\frac{10(VREF7-VREF6)}{16}+VREF6$ |

FIG. 21A
(PRIOR ART)
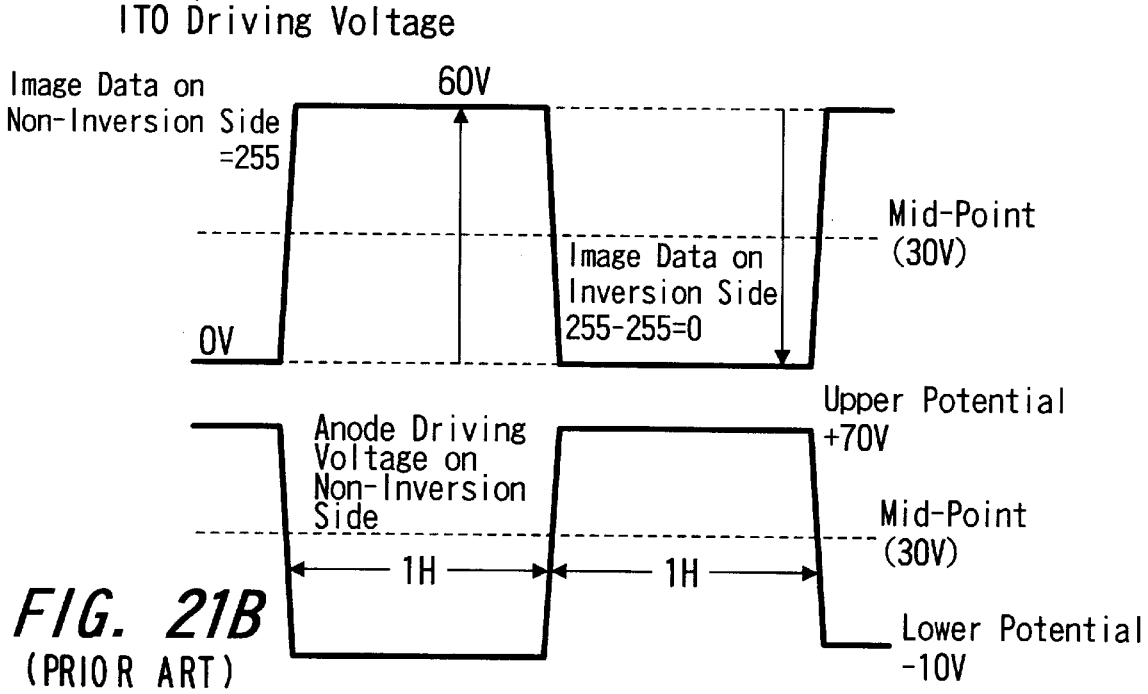
FIG. 21B
(PRIOR ART)
FIG. 22
(PRIOR ART)
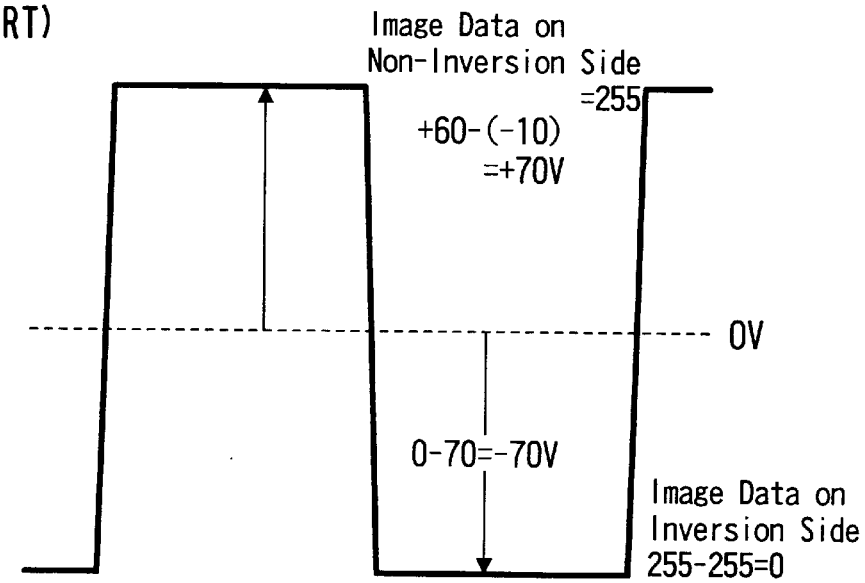

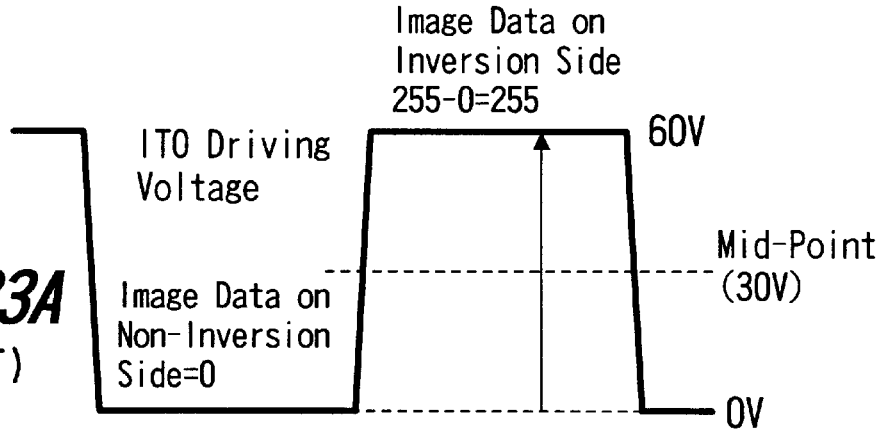
FIG. 23A
(PRIOR ART)
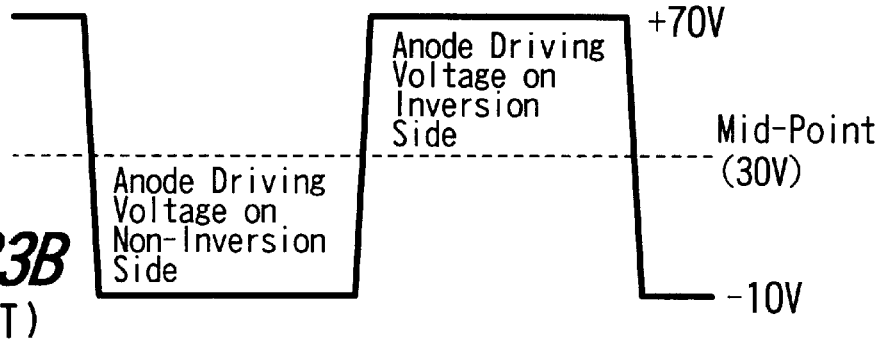
FIG. 23B
(PRIOR ART)
FIG. 24
(PRIOR ART)
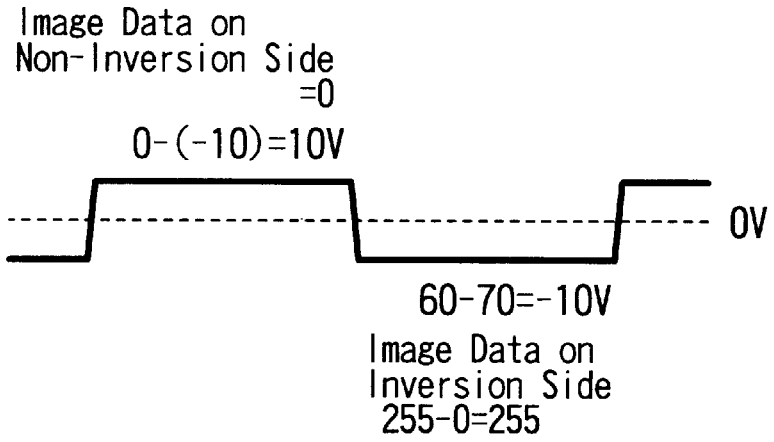

FIG. 25A
(PRIOR ART)
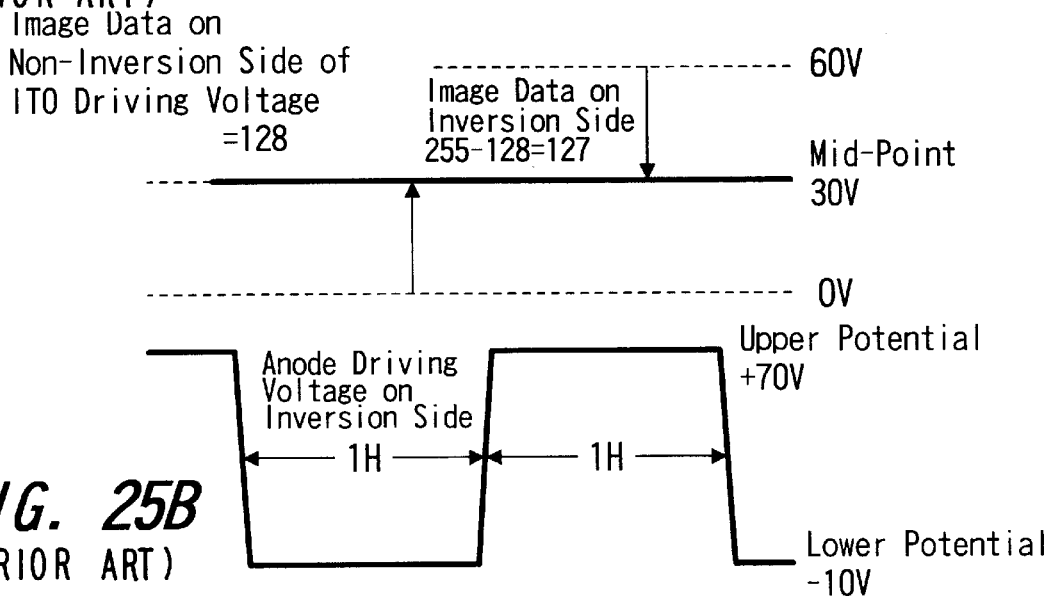
FIG. 25B
(PRIOR ART)
FIG. 26
(PRIOR ART
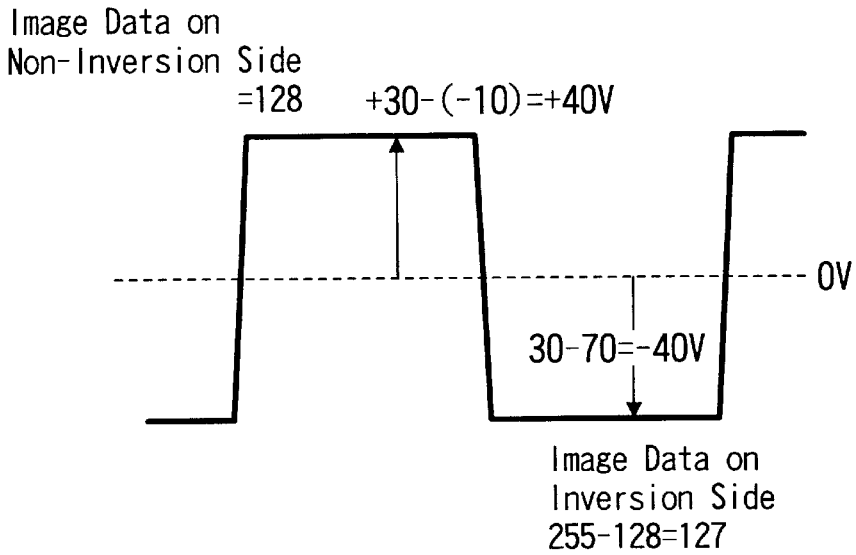

DRIVING APPARATUS FOR PLASMA ADDRESSED LIQUID CRYSTAL DISPLAY APPARATUS

BACKGROUND OF THE INVENTION

1. Field of the Invention

The present invention relates to a driving apparatus of a liquid crystal display apparatus in which a plasma addressed liquid crystal display apparatus is used.

2. Description of the Related Art

Recently, after an installation space or the like which can be secured at home, for example, is taken into consideration, a large-sized and thin-type television image receiver and a back-projection type projector apparatus have been in common use in order to obtain a more forceful image.

According to technical progress, such a television image receiver and a back-projection type projector apparatus have been thinner compared with the conventional ones. However, there is a limit in their thinning because of structural conditions such as depth of a CRT (Cathode Ray Tube) of the television image receiver and installation angle of a projection lens of the projector apparatus.

In addition, a display device using a TFT (Thin Film Transistor) liquid crystal panel can be thinned further than the above-mentioned television image receiver and the protector apparatus. However, in order to produce a large-sized display apparatus, according to increase in number of TFTs formed by IC technique, more accurate producing technique is required, and the cost becomes very high due to decrease in the yield of production.

Therefore, there has been proposed a display device using a plasma addressed liquid crystal display apparatus (hereinafter, referred to as PALC from its initial), where a screen which is as large as those of the television image receiver and projector apparatus is formed and which is as thin as the TFT liquid crystal panel, as a display section.

Such a plasma addressed liquid crystal display apparatus can realize high luminance and high contrast which are as high as those of the TFT liquid crystal panel, and can realize a large screen by means of producing technique of a PDP (Plasma Display Panel). Moreover, the plasma addressed liquid crystal display apparatus is a normally white (or normally black) plasma addressed liquid crystal display apparatus.

There will be described below a structure of a PALC to be used in embodiments of the present invention, mentioned later, with reference to FIGS. 2 and 3. FIG. 2 is an exploded perspective view of a liquid crystal display apparatus using the PALC. FIG. 3 is a perspective view showing a part of the structure of the PALC, and shows a cross section of the part. As shown in FIG. 2, a PALC 1 has a structure of a transmitting display device where a luminous flux radiated from a back light 2 arranged on a rear surface of the PALC 1 is selectively transmitted by an active-matrix method, and thus an image is formed.

As shown in FIG. 3, a plasma substrate (rear glass) 5 is formed with scanning grooves 7, 7, 7, . . . which are partitioned with an uniform interval into a hollow shape in a horizontal direction, for example, (or scanning grooves which are formed by cutting) by partition walls 6, 6, 6, . . . Anode electrodes 8, 8, 8, . . . and cathode electrodes 9, 9, 9, . . . are formed respectively in the scanning grooves 7 with an uniform interval so as to make a pair. Namely, the scanning grooves 7 compose horizontal scanning lines corresponding to an effective screen of the PALC 1, and the scanning grooves 7 are formed correspondingly to a number of the scanning lines (for example, about 480 lines).

A thin glass substrate 10 forming an insulating layer is provided on the forward side of ribs 6, 6, 6, . . . so that the scanning grooves 7 can be sealed. A noble gas such as a helium gas or a mixed gas of noble gases is charged as a plasma gas into the scanning grooves 7.

In addition, an about −300 V scanning voltage of a negative polarity pulse, for example, is applied from a driver circuit of plasma discharge, not shown, to the cathode electrodes 9 with a predetermined timing (here, a ground electric potential is given to the anode electrodes 8), and as detailed later, a plasma discharge takes place between the anode electrodes 8 and the cathode electrodes 9.

Due to this plasma discharge, the plasma gas is ionized in the scanning grooves 7, and electrically conductive bodies, namely plasma channels are formed until the plasma particles completely vanish so that a selecting operation (strobe) which is equivalent to that of a switching element is performed.

On the front side of a thin plate glass substrate 10, a liquid crystal layer 11 for forming an image in a matrix pattern, color filters 12 which are composed of striped red, green and blue filter sections 12R, 12G and 12B corresponding to the colors of red, green and blue, transparent driving electrodes (as one example, ITO (Indium Tin Oxide) thin films) 13 which are composed of striped red, green and blue driving electrodes 13R, 13G and 13B for driving pixels of the liquid crystal layer 11 are arranged with an uniform interval so as to intersect perpendicularly to the scanning grooves 7, 7, 7, . . . Each of the intersected portions becomes each of the pixels.

Namely, an image signal (data) for one horizontal line amount is supplied to the transparent driving electrodes 13R, 13G and 13B of the PALC 1, and the plasma gases in the scanning grooves 7 are selected (strobe) in a vertical direction successively so as to be discharged. As a result, the image signal is applied to the liquid crystal of the pixels where the transparent driving electrodes 13R, 13G and 13B intersect perpendicularly to the scanning grooves 7, and transmittance of a light emitted from the back light 2 is different at each of the pixels so that a color image can be displayed.

Namely, as shown in FIG. 2, when polarization filters 3 and 4 are arranged respectively on an incident side and an emission side of the PALC 1, a quantity of transmitted light polarized by the PALC 1 can be controlled. As a result, a color image can be obtained by a principle which is similar to that of a normal TFT liquid crystal display apparatus.

Detailed below is the switching operation for forming an image for 1 field amount with reference to FIGS. 4 and 5. FIG. 4 is a schematic diagram showing a portion of the PALC 1 shown in FIG. 3 viewed from the side. Here, in order to explain the switching operation by means of plasma channels, for convenience, a switch SW is shown in FIG. 5A.

As mentioned above, when a plasma generating pulse of −300 V, for example, is applied to the cathode electrodes 9 (a ground electric potential is given to the anode electrodes 8) so that plasma discharge is caused, plasma channels are formed in the scanning grooves 7. The plasma channels become virtual electrodes so that an image signal voltage is applied between the transparent driving electrode layers 13 (red, green and blue driving electrodes 13R, 13G and 13B) and the anode electrodes 8.

FIG. 4 shows a state that when the voltage of −300 V is applied to the cathode electrode 9 by the switch SW, the plasma gas is generated by discharge in the scanning groove 7 on the first line, and the strobe is turned ON. The plasma gas is not yet generated in the scanning groove 7 on the second line, and the strobe is remained OFF. As shown in FIG. 4, when the plasma channels are formed by the plasma discharge, the inside of scanning grooves 7 is in a conducting state, and this, as shown in FIG. 5B, can be equivalently explained as an operation of an FET (Field-effect Transistor) switching element.

This switching operation by means of the plasma channels generates a virtual electrode on an inner surface of the thin glass (substrate) 10 in FIG. 4. Here, when an image signal voltage for driving pixels is applied to the transparent driving electrodes 13R, 13G and 13B, a driving voltage is applied to the respective pixels (for 1 line amount) of the liquid crystal layer 11 which become the intersections between the scanning grooves 7 where plasma discharge is taking place and the transparent driving electrodes 13R, 13G and 13B.

Therefore, scanning is executed so that the plasma discharge takes place in the scanning grooves 7 successively (for example, on the first through 480th lines), and an image of 1 field, for example, is formed. As a result, the image for 1 field amount can be displayed.

Namely, after selection is made as to an image on which line is formed by the plasma channel, a driving voltage for forming the image on that line is applied to the red, green and blue driving electrodes 13R, 13G and 13B so that the selective scanning of the line composing one field is realized. At this time, a light transmitted through the liquid crystal layer 11 is transmitted through the red, green and blue filter sections 12R, 12G and 12B of the color filter 12 so that a color image can be displayed. As a result, the driving voltage is applied successively to the cathode electrodes on the 1st through 480th lines synchronously with the driving of the pixels for 1 line so that an image for 1 field amount can be formed.

When the display device is composed by using a PALC which can form an image by means of such a structure and operational principle, a thin and light display device having a large screen can be constituted.

There will be detailed below concrete circuits of the driving apparatus of the liquid crystal display apparatus device having the conventional plasma addressed liquid crystal display apparatus with reference to FIG. 20. In FIG. 20, a broadcasting receiving means such as an NTSC-system U/V tuner or a BS tuner, not shown, and one or plural input terminals for inputting a standard video signal reproduced by an external equipment such as a VTR or the like are provided at the previous stage of an NTSC (National Television System Committee) demodulating section 21.

The standard video signal selected by the broadcasting receiving means and external standard video signal(s) input from the one or plural input means are selected in the display device and then supplied to the NTSC demodulating section 21.

The NTSC demodulating section 21 demodulates the standard video signal into a brightness signal and a color-difference signal, and the brightness signal and the color-difference signal are supplied to a double speed converting section 22. Moreover, the demodulating section 21 extracts a synchronizing signal from the demodulated brightness signal so as to supply the synchronizing signal to a LCD (Liquid crystal display apparatus) controller 28, mentioned later. Operating clocks of respective function circuits, mentioned below, are generated in the LCD controller 28 so that various signal processes are synchronized.

A frame memory which can store an image signal brightness signal and color-difference signal) for 1 frame amount thereinto is provided in the double speed converting section 22, and a motion component is detected by utilizing the frame memory. In a static image area of the image signal written into the frame memory, an image signal for 1 horizontal period in a field at that time and 1 field previous to that field is read out two times continuously with a speed twice as fast as a writing speed.

In addition, in a dynamic image area of the image signal written into the frame memory, an interpolating image signal, which is generated by an interpolation process by means of an image signal for 1 horizontal period of field information at that time and image signals for one up and down horizontal periods, is read out with a doubled speed, and the interpolating image signal is converted into a non-interlace signal of 525 H/60 Hz.

After the image signal which was subjected to the double speed process undergoes color adjustment, hue adjustment and the like in an image signal processing section 23, primary-colors signals of red, green and blue are generated by a matrix process. The respective primary-colors signals generated in the image signal processing section 23 are subject to gain adjustment by a gain regulator 24 for adjusting gain according to a control signal from a micro computer control section 33 and then supplied to an A/D converter 25 having 8-bit quantizing accuracy. Then, the primary-colors signals are converted into red, green and blue digital image data V8 therein. The gain regulator 24 reduces a level of an input signal to be supplied to the A/D converter 25 and reduces a number of gray scales of the image data to be displayed. As a result, a driving voltage to the transparent electrodes 13 is lowered, and thus the contrast is reduced.

The red, green and blue image data V8 obtained by the A/D converter 25 are subject to a white balance process in a white balance regulating section 26 and then supplied to a liquid crystal column driver 27.

The liquid crystal column driver 27 latches image data for 1 horizontal period (for example, 854 pixels), namely image data V8 of 854 pixels×3 channels (red, green, blue), namely, 2562 pixels, and holds the image data V8 for each pixels for 1 horizontal period. When the plasma discharge is generated in the predetermined scanning groove 7 (FIG. 3) by a plasma driver 31, mentioned later, the image data V8 are read out per 1 horizontal line. The image data V8 are converted into analog signals by a D/A converter provided in the liquid crystal column driver 27 and then applied to the transparent driving electrodes (ITO) 13 (red, green and blue driving electrodes 13R, 13G and 13B) (FIG. 3) of a PALC (plasma addressed liquid crystal display apparatus) 36 (1).

The LCD controller 28 is composed :so as to be operated by a power supply of 5V, for example. The LCD controller 28 generates an anode inversion pulse (H pulse), for driving an anode inversion driving circuit 30, and a plasma pulse, for driving a plasma driver 31 so that the plasma discharge takes place per scanning groove 7 (horizontal line), based on an operating clock-generated based on the synchronizing signal from the NTSC demodulating section 21.

A reference voltage VREF from a reference voltage generating circuit 29 is applied to the liquid crystal column driver 27 containing a charge and hold type D/A converter, mentioned later so as to drive the transparent driving electrodes 13 of the PALC 36 (1). Moreover, an anode driving voltage from the anode inversion driving circuit 30 is applied to the anode electrodes 8 of the PALC 36 (1).

The plasma driver 31 successively selects horizontal scanning lines corresponding to about 480 lines composing an NTSC screen, namely, the scanning grooves 7 formed in the PALC 36 (1) as shown in FIG. 3 so as to supply plasma pulses, and allows the plasma discharge to take place according to the power-supply voltage of about −300 V applied to the cathode electrodes 9.

In other words, plasma discharge occurs in the scanning grooves 7, 7, 7, . . . successively from, for example, the top to the bottom in synchronization with the image data V8 with the doubled speed inputted into the liquid crystal column driver 27, and the discharge state is repeated per field so that the PALC 36 (1) can be driven according to the image data mentioned above. As a result, the inputted standard video signal can be displayed as an image.

As shown in FIG. 2, a back light 35 (2) is provided as a light source for illuminating the PALC 36 (1) from the back side. The luminous flux emitted from the back light 35 (2) transmits through predetermined pixels of the PALC 36 (1) so that a display image is formed. Moreover, the brightness of the back light 35 (2) is adjusted so that a picture can be adjusted.

The micro computer control section 33 makes various controls such as selection of the tuners, the adjustment of an image and on/off operation of the power supply or the like according to commands inputted by a user using an operating section 32. Here, in FIG. 20, an object to be controlled by the micro computer control section 33 and the micro computer control section 33 are connected with each other by a broken line.

In the driving apparatus of the liquid crystal display apparatus having the conventional plasma addressed liquid crystal display apparatus described with reference to FIG. 20, when the gain regulator 24 lowers a level of the input signal to be supplied to the A/D converter 25 and reduces a number of gray scales of image data to be displayed, a driving voltage for driving the transparent electrodes 13 is lowered so that the contrast is reduced.

At this time, for example, at the minimum point of the contrast adjustment, the level of the input signal is reduced by about 25%, namely, reduced to about ¼. However, as a result, 256 (8 bits) gray scales of a driving voltage becomes about 64 (6 bits) gray scales, and thus there arises a problem that S/N of the display image is lowered.

SUMMARY OF THE INVENTION

From the above viewpoint, it is an object of the present invention to provide a driving apparatus of a plasma addressed liquid crystal display apparatus, where even when the contrast of a display image is reduced, S/N is not deteriorated. The plasma addressed liquid crystal display apparatus has a first transparent scanning electrode group arranged on a first surface of a liquid crystal display apparatus, and a second scanning electrode group which is arranged on a second surface of the liquid crystal display apparatus so as to face the first electrode group and forms plural plasma discharge channels in a direction intersecting perpendicularly to the first scanning electrode group.

A driving apparatus of a plasma addressed liquid crystal display apparatus according to the present invention is provided with, in the plasma addressed liquid crystal display apparatus having a first transparent scanning electrode group arranged on a first surface of a liquid crystal displace apparatus, and a second scanning electrode group arranged to oppose a second surface of the liquid crystal display apparatus and to form a plurality of plasma discharge channels in a direction perpendicular to the first scanning electrode group, a reference voltage selection D/A converter for applying a driving voltage to the first scanning electrode group, a common anode inversion driving voltage generating means for applying a common anode inversion driving voltage obtained by relatively inverting a driving voltage to the second scanning electrode group, and a contrast reduction adjusting means for simultaneously tracking a voltage on a low voltage side when a reference voltage is not inverted in the reference voltage selection D/A converter and a power-supply voltage on a high voltage side at the time of inversion and increasing/decreasing the voltages so as to adjust reduction in contrast.

According to the present invention, the contrast reduction adjusting means is simultaneously tracking a voltage on the low-voltage side when a reference voltage is not inverted in the reference voltage selection D/A converter and a voltage on a high-voltage side at the time of inversion, and increases and reduces the voltages so as to adjust reduction in contrast.

The present invention is a driving apparatus of a plasma addressed liquid crystal display apparatus provided with, a plasma addressed liquid crystal display apparatus having a first transparent scanning electrode group arranged on a first surface of the liquid crystal display apparatus and a second scanning electrode group arranged so as to oppose a second surface of the liquid crystal display apparatus and to form a plurality of plasma discharge channels in a direction perpendicular to the first scanning electrode group, a reference voltage selection D/A converter for applying a driving voltage to the first scanning electrode group, a common anode inversion driving voltage generating means for applying a common anode inversion driving voltage obtained by relatively inverting a driving voltage to the second scanning electrode group, and a contrast reduction adjustment means for simultaneously tracking a voltage on a low voltage side when a reference voltage is not inverted in the reference voltage selection D/A converter and a power-supply voltage on a high voltage side at the time of inversion and increasing/decreasing the voltages so as to adjust reduction in contrast.

BRIEF DESCRIPTION OF THE DRAWINGS

FIG. 7 is a diagram showing the polarity of a line inversion driving;

FIG. 9 is a timing chart showing a phase relationship between image data to be written into the liquid crystal display apparatus and plasma discharge pulse in which FIG. 9A is a waveform chart showing image output data which are subject to a D/A conversion;

FIG. 9B is a waveform chart showing a gate voltage of an NMOS transistor on the first line;

FIG. 9C is a waveform chart showing a cathode waveform on the first line;

FIG. 9D is a waveform chart showing a gate voltage of an NMOS transistor on the second line; and FIG. 9E is a waveform chart showing a cathode voltage of the NMOS transistor on the second line;

FIG. 21A is a waveform chart showing a driving waveform of ITO when brightness is 0 IRE according to the conventional example;

FIG. 21B is a waveform chart showing a driving waveform of an anode electrode when brightness is 0 IRE according to the conventional example;

FIG. 22 is a waveform chart showing a liquid crystal driving voltage waveform when an anode potential is standardized according to the conventional example;

FIG. 23A is a waveform chart showing a driving waveform of the ITO when brightness is 100 IRE according to the conventional example;

FIG. 23B is a waveform chart showing a driving waveform of the anode electrode when brightness is 100 IRE according to the conventional example;

FIG. 24 is a waveform chart showing a driving voltage waveform of liquid crystal when the anode potential is standardized according to the conventional example;

FIG. 25A is a waveform chart showing a driving waveform of ITO when contrast is ½ (50%) and brightness is 100 IRE according to the conventional example;

FIG. 25B is a waveform chart showing a driving waveform of the anode electrode when contrast is ½ (50%) and brightness is 100 IRE according to the conventional example; and FIG. 26 is a waveform chart showing a driving voltage waveform when the anode potential is standardized according to the conventional example.

DESCRIPTION OF THE PREFERRED EMBODIMENTS

Figure 1:
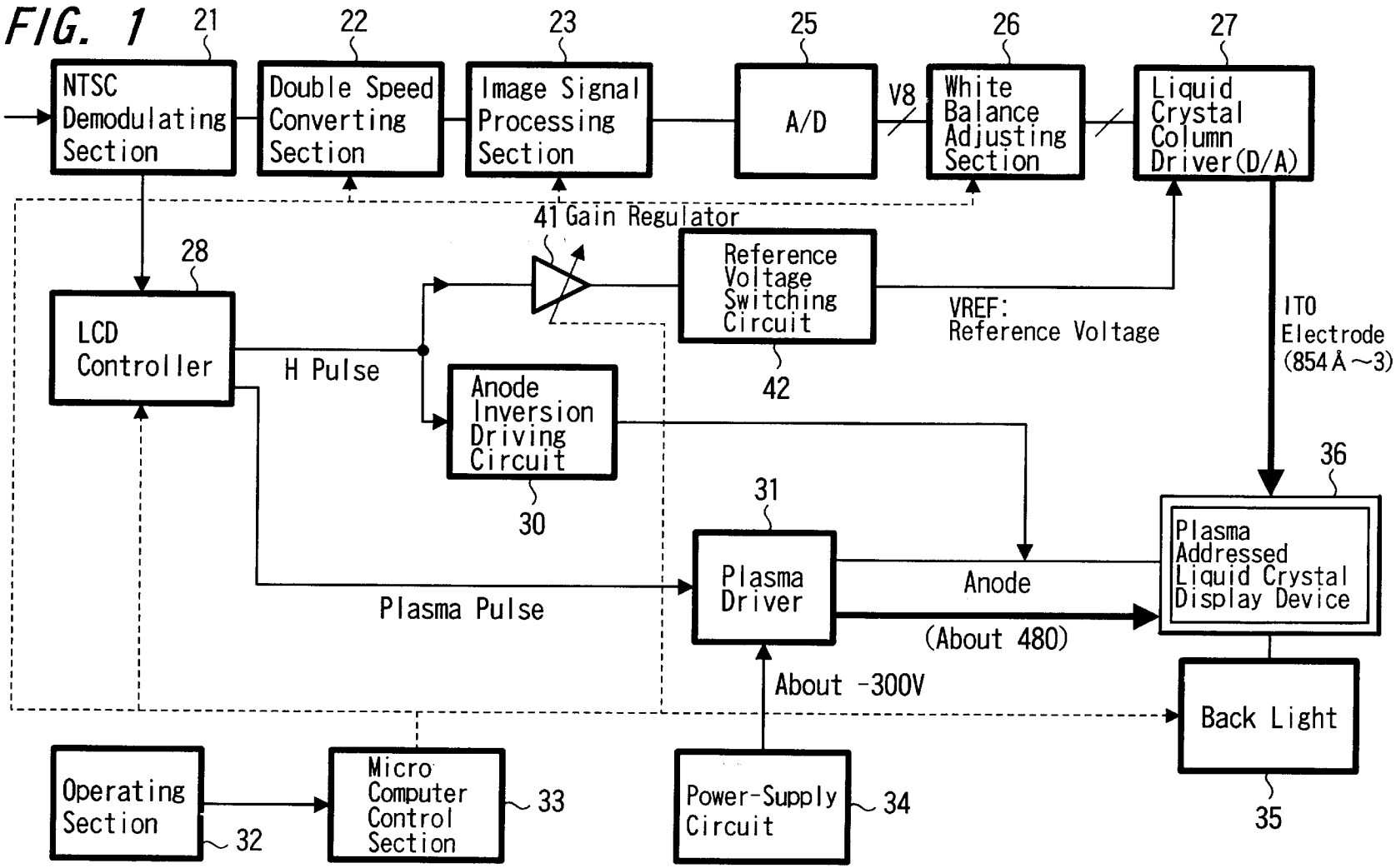
FIG. 1 is a block diagram showing a driving apparatus of a plasma addressed liquid crystal display apparatus according to an embodiment of the present invention.

There will be detailed below embodiments of the present invention with reference to the drawings. At first, the description will be given as to a concrete circuit of a driving apparatus of a liquid crystal display apparatus having a normally white plasma addressed liquid crystal display apparatus according to the embodiment with reference to FIG. 1. In FIG. 1, the same reference numerals are given to parts corresponding to those of FIG. 20. FIG. 1 is a circuit block diagram showing particularly a part of an image system in the driving apparatus of the plasma addressed liquid crystal display apparatus according to the embodiment. Here, in the description of a concrete structure of a plasma addressed liquid crystal display apparatus 36 in FIG. 1, the description given in the prior art with reference to FIGS. 2 through 5 is used.

In FIG. 1, a broadcasting receiving means such as NTSC-system U/V tuner, BS tuner or the like, not shown, and one or plural input terminal(s) for inputting a standard video signal reproduced by an external equipment such as a VTR or the like are provided at the previous stage of an NTSC (National Television System Committee) demodulating section 21.

The standard video signal selected by the broadcasting receiving means and external standard video signal(s) inputted from the one or plural input means are selected in the display device and then supplied to the NTSC demodulating section 21.

The NTSC demodulating section 21 demodulates the standard video signal into a brightness signal and a color-difference signal, and the brightness signal and the color-difference signal are supplied to a double speed converting section 22. Moreover, the demodulating section 21 extracts a synchronizing signal from the demodulated brightness signal so as to supply the synchronizing signal to a LCD (Liquid crystal display apparatus) controller 28, mentioned later. Operating clocks of respective function circuits, mentioned below, are generated in the LCD controller 28 so that various signal processes are synchronized.

A frame memory which can store an image signal (brightness signal and color-difference signal) for 1 frame amount thereinto is provided in the double speed converting section 22, and a motion component is detected by utilizing the frame memory. In a static image area of the image signal written into the frame memory, image signals for 1 horizontal period in a field at that time and 1 field previous to that field are read out two times continuously with a speed twice as fast as a writing speed.

In addition, in a dynamic image area of the image signal written into the frame memory, an interpolating image signal, which is generated by an interpolation process using an image signal for 1 horizontal period of field information at that time and image signals for 1 up and down horizontal periods, is read out with a doubled speed, and the interpolating image signal is converted into a non-interlace signal of 525 H/60 Hz.

After the image signal which was subject to the double speed process undergoes color adjustment, hue adjustment and the like in an image signal processing section 23, respective primary-colors signals of red, green and blue are generated by a matrix process. The respective primary-colors signals generated in the image signal processing section 23 are converted into red, green and blue digital image data V8 by an A/D converter 25 having 8-bit quantization accuracy.

The red, green and blue image data V8 obtained by the A/D converter 25 are subject to a white balance process in a white balance regulating section 26 and then supplied to a liquid crystal column driver 27.

The liquid crystal column driver 27 latches image data for 1 horizontal period (for example, 854 pixels), namely image data V8 of 854 pixels×3 channels (red, green, blue), namely, 2562 pixels, and holds the image data V8 for each pixel for 1 horizontal period. When the plasma discharge is generated in predetermined scanning grooves 7 (FIG. 3) by a plasma driver 31, mentioned later, the image data V8 are read out per 1 horizontal line. The image data V8 are converted into analog signals by a D/A converter provided in the liquid crystal column driver 27 so as to be applied to transparent driving electrodes (ITO) 13 (red, green and blue driving electrodes 13R, 13G and 13B) (FIG. 3) of a PALC (plasma addressed liquid crystal display apparatus) 36 (1).

The LCD controller 28 is composed so as to be operated by a power supply of 5V, for example. The LCD controller 28 generates an anode inversion pulse (H pulse), for driving an anode inversion driving circuit 30, and a plasma pulse, for driving a plasma driver 31 so that the plasma discharge takes place per scanning groove 7 (horizontal line), based on an operating clock generated by a PLL circuit based on the synchronizing signal from the NTSC demodulating section 21.

An image signal sampled at every pixel is supplied to the liquid crystal column driver 27 using a reference voltage selection D/A converter, mentioned later, so as to drive the transparent driving electrodes 13 of the plasma addressed liquid crystal display apparatus 36.

The anode inversion pulse (H pulse) from the LCD controller 28 is supplied also to a gain regulator 41 so that its gain is adjusted, and then it is supplied to a reference voltage switching circuit 42 so that a reference voltage is switched. The switched reference voltage is supplied to the liquid crystal column driver 27 containing a charge and hold type D/A converter, mentioned later, so as to drive the transparent column electrodes 13 of the PALC 36 (1). Moreover, an anode driving voltage from the anode inversion driving circuit 30 is applied to anode electrodes 8 of the PALC 36 (1).

Figure 3:
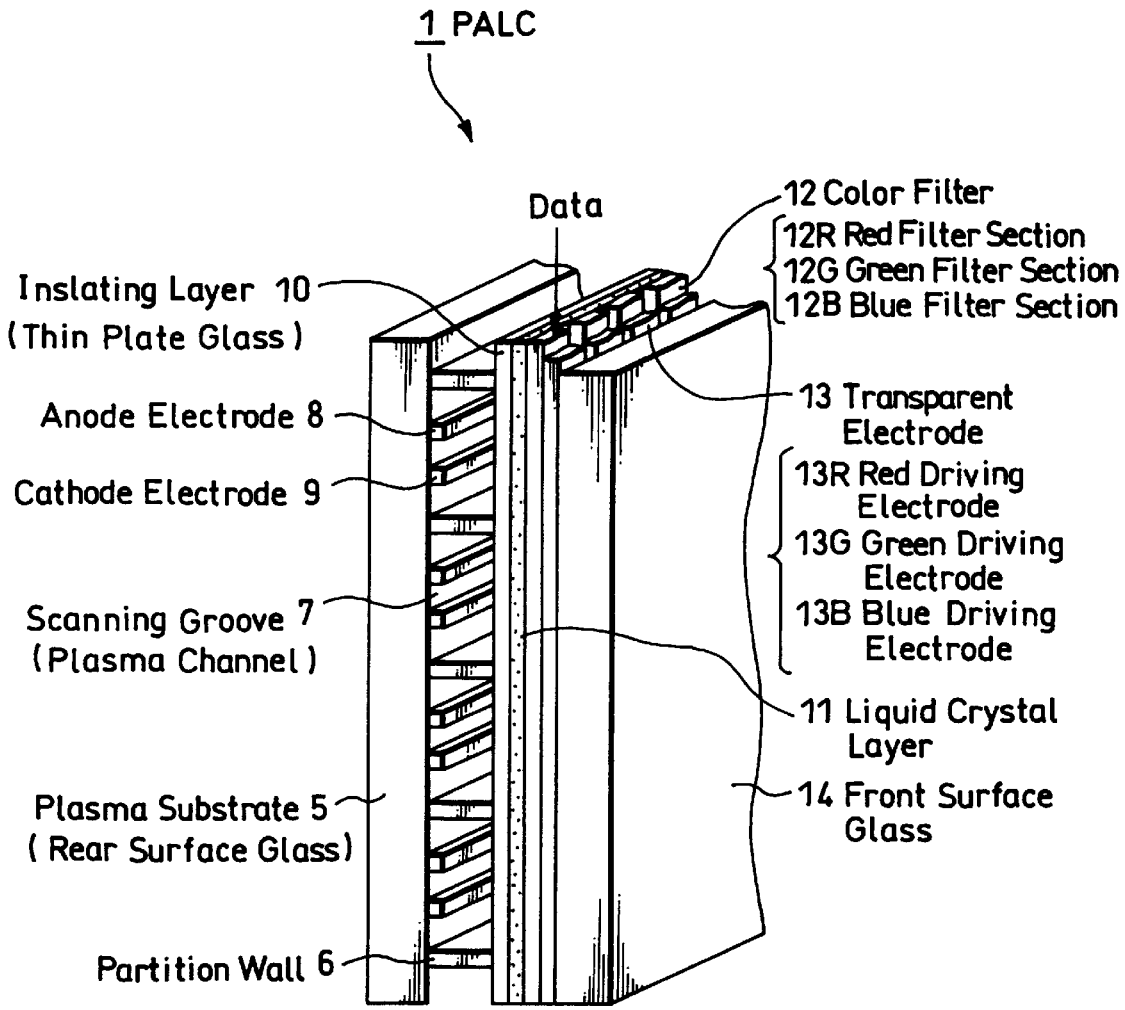
FIG. 3 is a perspective view of the plasma addressed liquid crystal display apparatus used in the embodiment, with a part being cut away.
Figure 4:
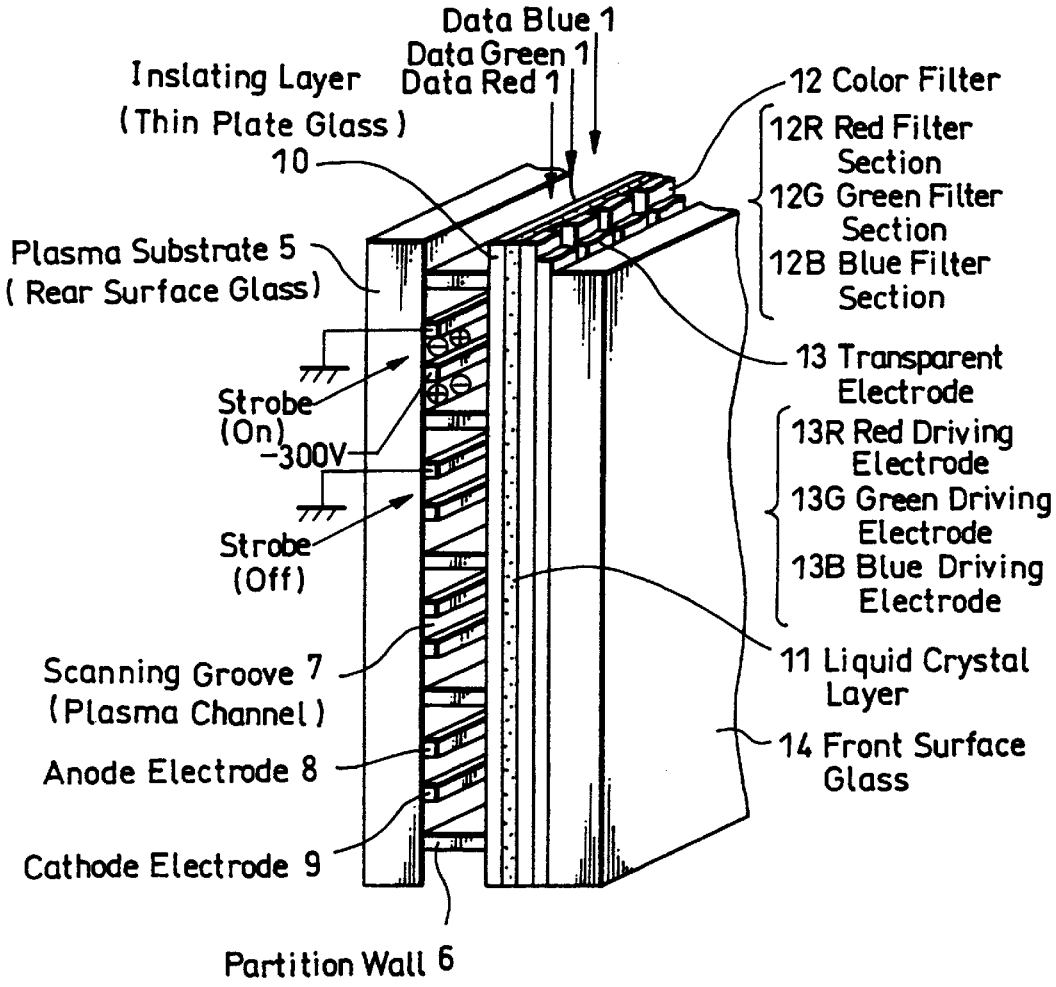
FIG. 4 is a perspective view of the plasma addressed liquid crystal display apparatus, with a part being cut away, for explaining generation of plasma channels due to plasma discharge.
Figure 5A:
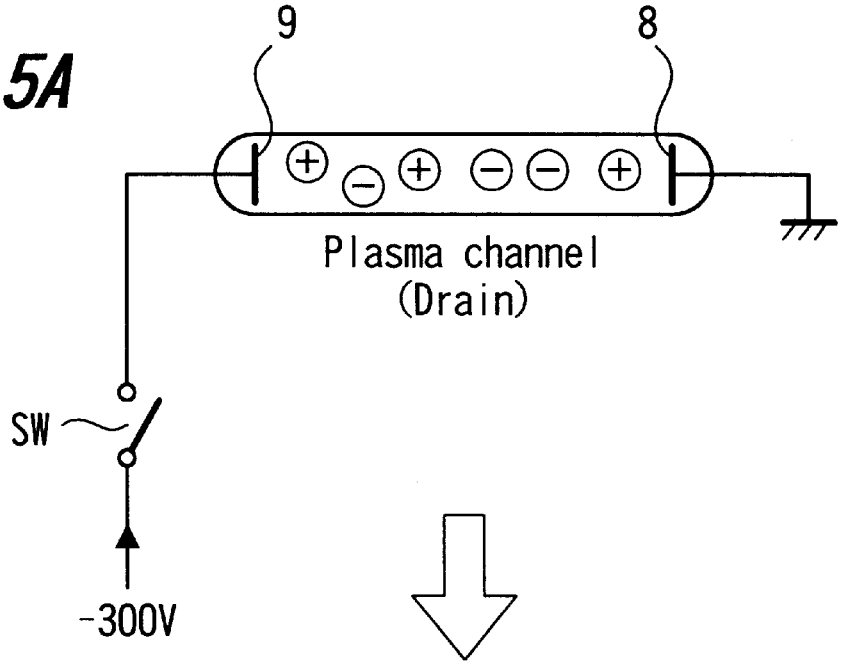
FIG. 5A is a circuit diagram showing the plasma channels.
Figure 5B:
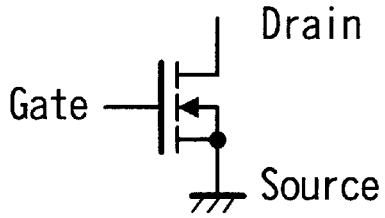
FIG. 5B is a circuit diagram showing an equivalent circuit of the plasma channels.

The plasma driver 31 successively selects horizontal scanning lines corresponding to about 480 lines composing an NTSC screen, namely, the scanning grooves 7 formed in the PALC 36 (1) as shown in FIG. 3 so as to supply plasma pulses, and allows the plasma discharge to take place according to the power-supply voltage of about −300 V applied to cathode electrodes 9.

In other words, plasma discharge is generated in the scanning grooves 7, 7, 7, . . . successively from, for example, the top to the bottom in synchronization with the image data V8 with doubled speed inputted into the liquid crystal column driver 27, and the discharge state is repeated per field so that the PALC 36 (1) can be driven according to the image data. As a result, the inputted standard video signal can be displayed as an image.

Figure 2:
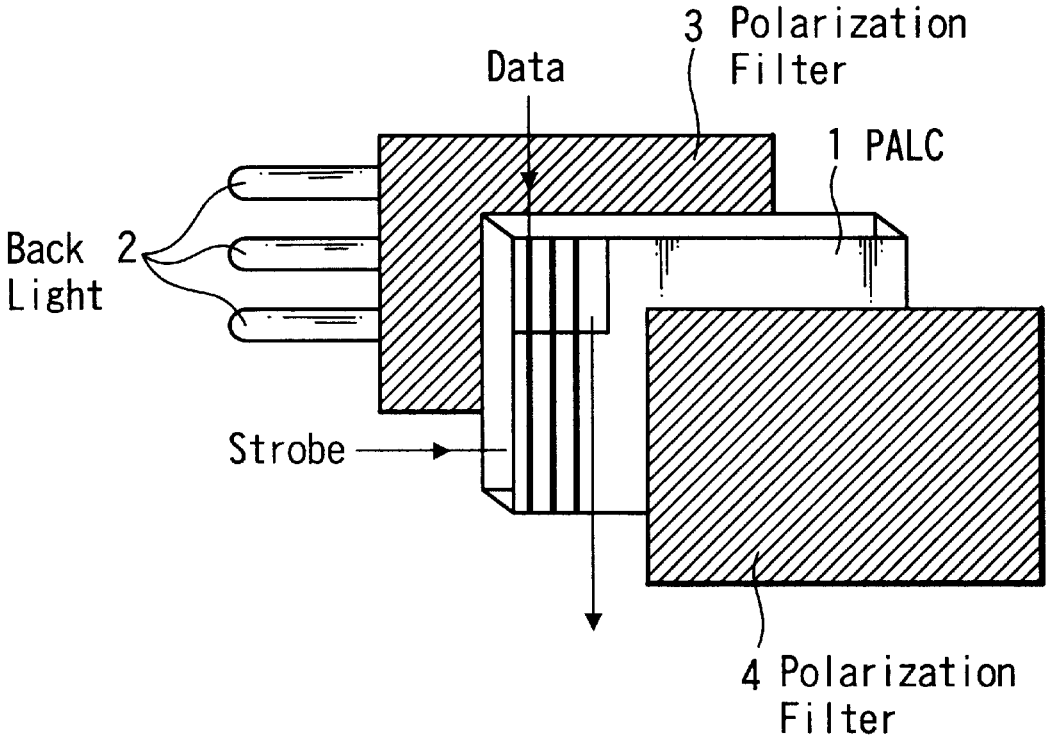
FIG. 2 is an exploded perspective view showing the plasma addressed liquid crystal display apparatus used in the embodiment.

As shown in FIG. 2, a back light 35 (2) is provided as a light source for illuminating the PALC 36 (1) from the back side. The luminous flux emitted from the back light 35 (2) transmits through predetermined pixels of the PALC 36 (1) so that a display image is formed. Moreover, the brightness of the back light 35 (2) is adjusted so that a picture can be adjusted.

The micro computer control section 33 makes various controls such as selection of the respective tuners, the adjustment of an image, on/off operation of the power supply or the like according to commands inputted by a user using an operating section 32. Here, in FIG. 1, an object to be controlled by the micro computer control section 33 and the micro computer control section 33 are connected with each other by a broken line.

Figure 8:
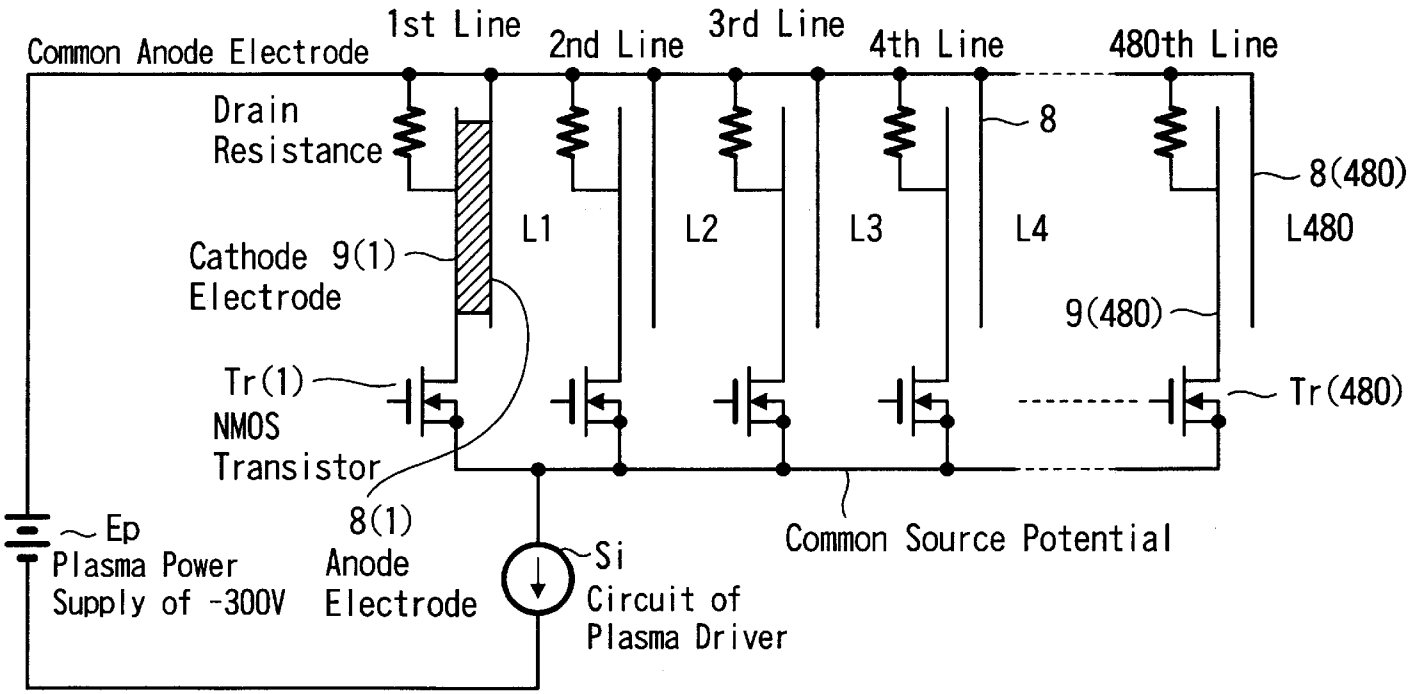
FIG. 8 is a circuit diagram showing a plasma discharge driver circuit used in the embodiment of the present invention.

There will be detailed below the plasma (discharge) driver 31 with reference to FIG. 8. FIG. 8 shows also the anode electrodes 8 and the cathode electrodes 9 of the PALC 36 (1). In the plasma driver 31, a voltage of about −300 V, for example, from a plasma power supply Ep is used, and this voltage is applied to the cathode electrodes 9(1) through 9(480) on the respective lines (for example, from the first line L1 to the 480th line: effective scanning line number) via switching means and an electric current source. The cathode electrodes 9(1) through 9(480) are connected with drains of NMOS (N channel MOS) transistors Tr(1) through Tr(480), for example, which are arranged as switching elements for plasma discharge.

Source electrodes of the NMOS transistors Tr(1) through Tr(480) are connected commonly, and are further connected with a negative electrode of the plasma power supply Ep via an electric current source Si of about 100 mA, for example. The NMOS transistors are controlled so that an electric current at the time of the plasma discharge becomes constant, and thus stable plasma discharge occurs. The anode electrodes 8(1) through 8(480) corresponding to the cathode electrodes 9(1) through 9(480) are connected commonly with a positive electrode of the plasma power supply Ep. Moreover, a positive pulse (plasma discharge pulse) of about 10 μsec, for example, which is supplied from the LCD controller 28, is applied to the gate electrodes of the NMOS transistors Tr(1) through Tr(480) successively per line.

When the plasma pulses from the LCD controller 28 are applied successively to the gate electrodes of the NMOS transistors Tr (1) through Tr (480), as represented by a shaded pattern, plasma discharge occurs between the anode electrode 8(1) and the cathode electrode 9(1) on the first line L1, for example. Thereafter, the plasma pulse is applied successively to the cathode electrodes 9(1) on the first line L1 through 9(480) on the 480th line L480 in synchronization with a pixel signal for 1 line. As a result, an image for 1 field can be formed.

Figure 9:
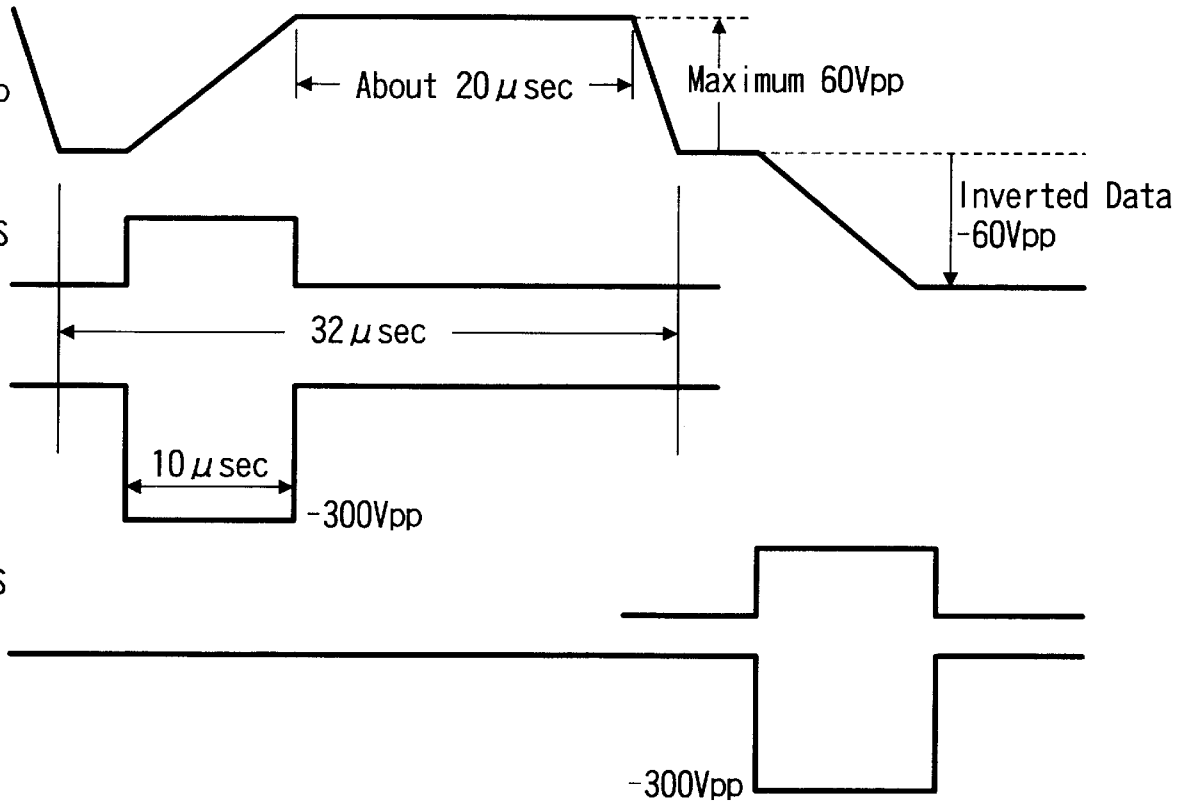

There will be described below a phase relationship between an image driving signal (writing image data) to be supplied to the PALC 1 and the plasma pulse with reference to FIG. 9. In the case where a scanning period for 1 line amount is 32 μsec, for example, when a positive plasma pulse voltage having width of 10 μsec is applied to the gate electrode of the NMOS transistor Tr(1) corresponding to, for example, the first line L1 at timing shown in FIG. 9B, a negative pulse voltage of −300 V having width of 10 μsec is applied to the cathode electrode 9(1) corresponding to the first line L1 as shown in FIG. 9C so that plasma discharge occurs in the first scanning groove 7. In the state that the plasma discharge occurs in the scanning groove 7, an image signal of 60 V maximumly shown in FIG. 9A, which is sampled and held per pixel, is applied to the driving electrode (ITO) 13 continuously for about 20 μsec, for example. As a result, the image signal for 1 line can be written into the PALC 36(1).

As shown in FIG. 9D, when a positive plasma pulse voltage having width of 10 μsec is applied to the gate electrode of the NMOS transistor Tr(2) on the second line L2, as shown in FIG. 9E, a negative pulse voltage of −300 V having width of 10 μsec is applied to the cathode electrode 9(2) corresponding to the second line L2 so that plasma discharge occurs in the next scanning groove 7. In the state that the plasma discharge occurs in the scanning groove 7, as shown in FIG. 9A, inverted data of the image signal of 60 V maximumly on the second line, which are sampled and held per pixel, are applied to the driving electrode (ITO) 13 continuously for about 20 μsec, for example. In such a manner, in the first field the inversion driving is executed alternatively on the odd-numbered lines and the even-numbered lines, and the inversion driving is further executed with inverse phase alternatively in the next field. As a result, AC driving in the PALC 36(1) is realized, and thus deterioration of the liquid crystal molecules due to continuous application of the DC voltage is prevented.

Namely, as shown in FIG. 7, in the first field of FIG. 7A, the inversion driving is executed alternatively at every odd-numbered line and even-numbered line, and in the next field of FIG. 7B, the inversion driving is further executed with inverse phase alternatively. As a result, the AC driving of the liquid crystal display apparatus is realized. Thus, the deterioration of the liquid crystal molecules is prevented.

When the image signals for 480 lines are written successively into the PALC 36 (1) at such timing, the image for 1 field can be formed and then displayed.

There will be described below a 7-bit reference voltage selection D/A converter, for example, for charging and holding an image signal, which is provided in the liquid crystal column driver 27 with reference to FIGS. 10 to 13.

Figures 12, 13:
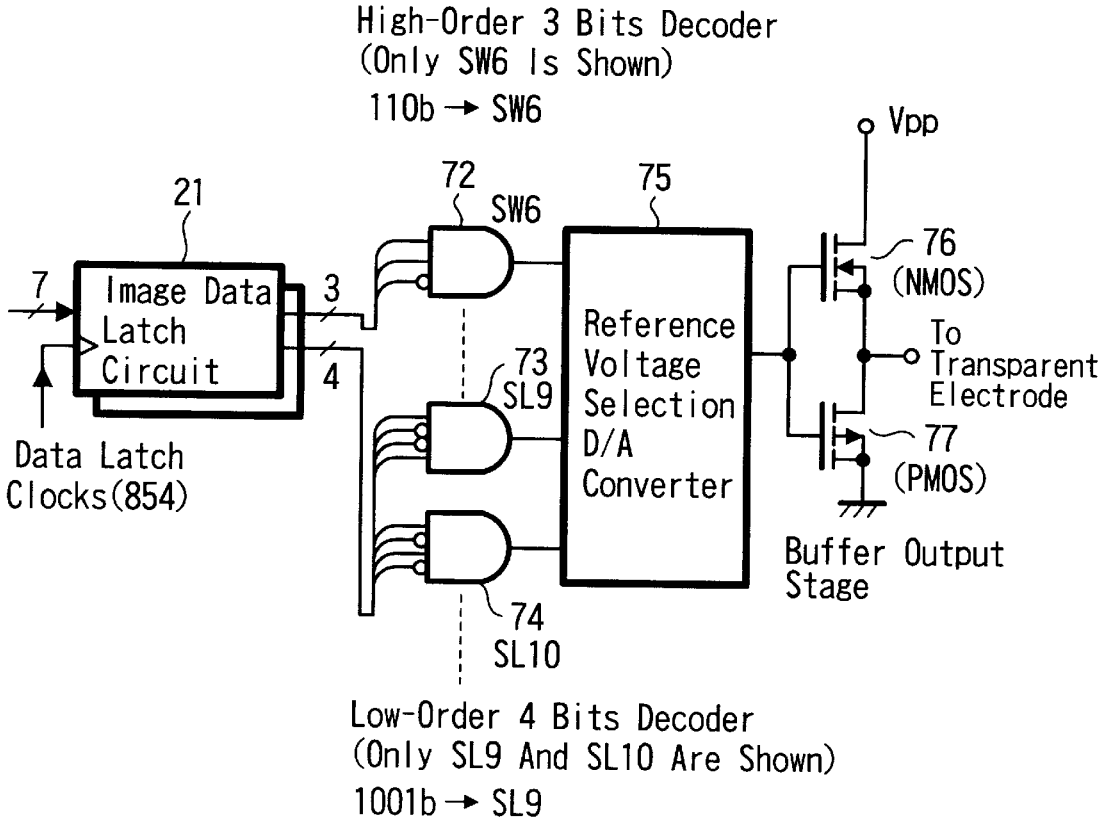
FIG. 12 is a circuit diagram showing the reference voltage selection D/A converter used in the embodiment of the present invention.
FIG. 13 is an explanatory diagram of an output voltage of the D/A converted when image data are 105.

As shown in FIG. 12, a shift register (not shown), which stores the image signal for 1 line successively per pixel, captures the final image data and simultaneously transfers the image signal for 1 line to an image data latch circuit 71 prepared only for a number of pixels (854) of 1 line so that the image data are latched by using 854 data latch clocks.

Thereafter, the image data are divided into data of high-order 3 bits and data of low-order 4 bits. The data of high-order 3 bits are supplied to eight decoders so that eight selection signals are obtained. The eight selection signals are supplied to eight double switch circuits (upper switch is connected with upper one end of a resistance ladder circuit, and a lower switch is connected with lower one end of a resistance ladder circuit) SW0 through SW7 for selecting VREF (m) and VREF (m+1) from reference voltages VREF 0 through VREF 8 shown in FIG. 10 in a reference voltage selection D/A converter 75. FIG. 12 shows only the decoder 72 of the eight decoders for supplying a selection signal to the double switch circuit SW6, and the other decoders are not shown. The data of low-order 4 bits are supplied to sixteen decoders so that the sixteen selection signals are obtained. The sixteen selection signals are supplied to sixteen selection switch circuits SL0 through SL15 for selecting sixteen divided voltages, which are obtained by dividing difference voltages (VHIGH−VLOW) between the top and bottom voltages VHIGH and VLOW of resistance ladder circuits (resistors R0 through R15) shown in FIG. 10 in the reference voltage selection D/A converter 75 by means of the resistance ladder circuits. FIG. 12 only shows the decoders 73 and 74 of the sixteen decoders for supplying selection signals to the selection switch circuits SL9 and SL10, and the other decoders are not shown.

Namely, as shown in FIG. 13, when the image data are 105, namely "1101001b", for example, the high-order 3 bits are "110". As a result, when the data "110" are supplied to the decoder 72, the output thereof becomes "high" (m=6). Since the low-order 4 bits are "1001", when the data "1001" are supplied to the decoder 73, the output thereof becomes "high" (n =9). Therefore, the both switches of the double switch circuits SW6 and the selection switch circuit SL9 in FIG. 10 are in the ON state.

Figure 10:
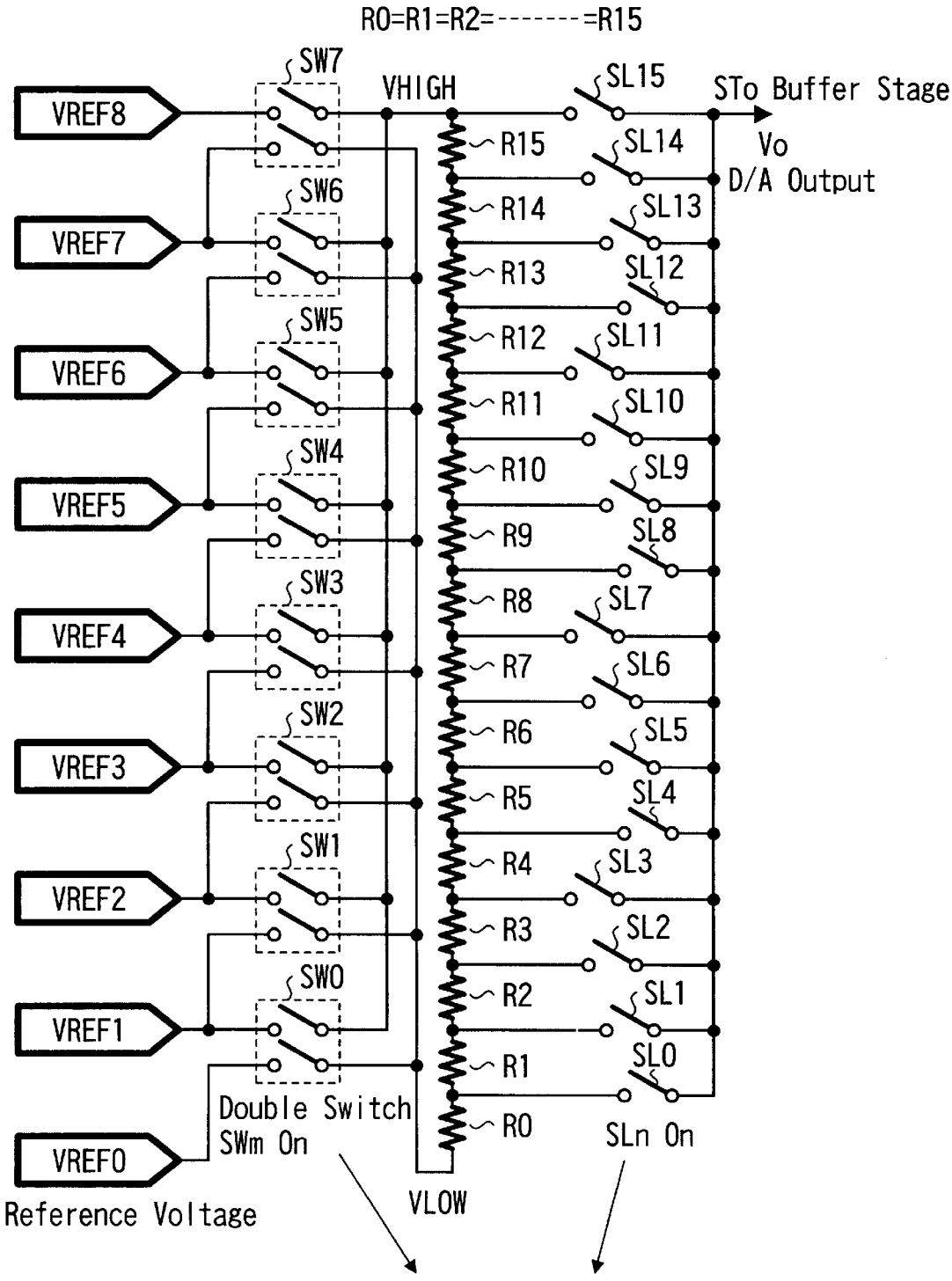
FIG. 10 is a circuit diagram showing a reference voltage selection type D/A converter of high-order 3 bits (8 ways)+ low-order 4 bits (16 ways) or totally 7 bits used in the embodiment of the present invention.
Figure 11:
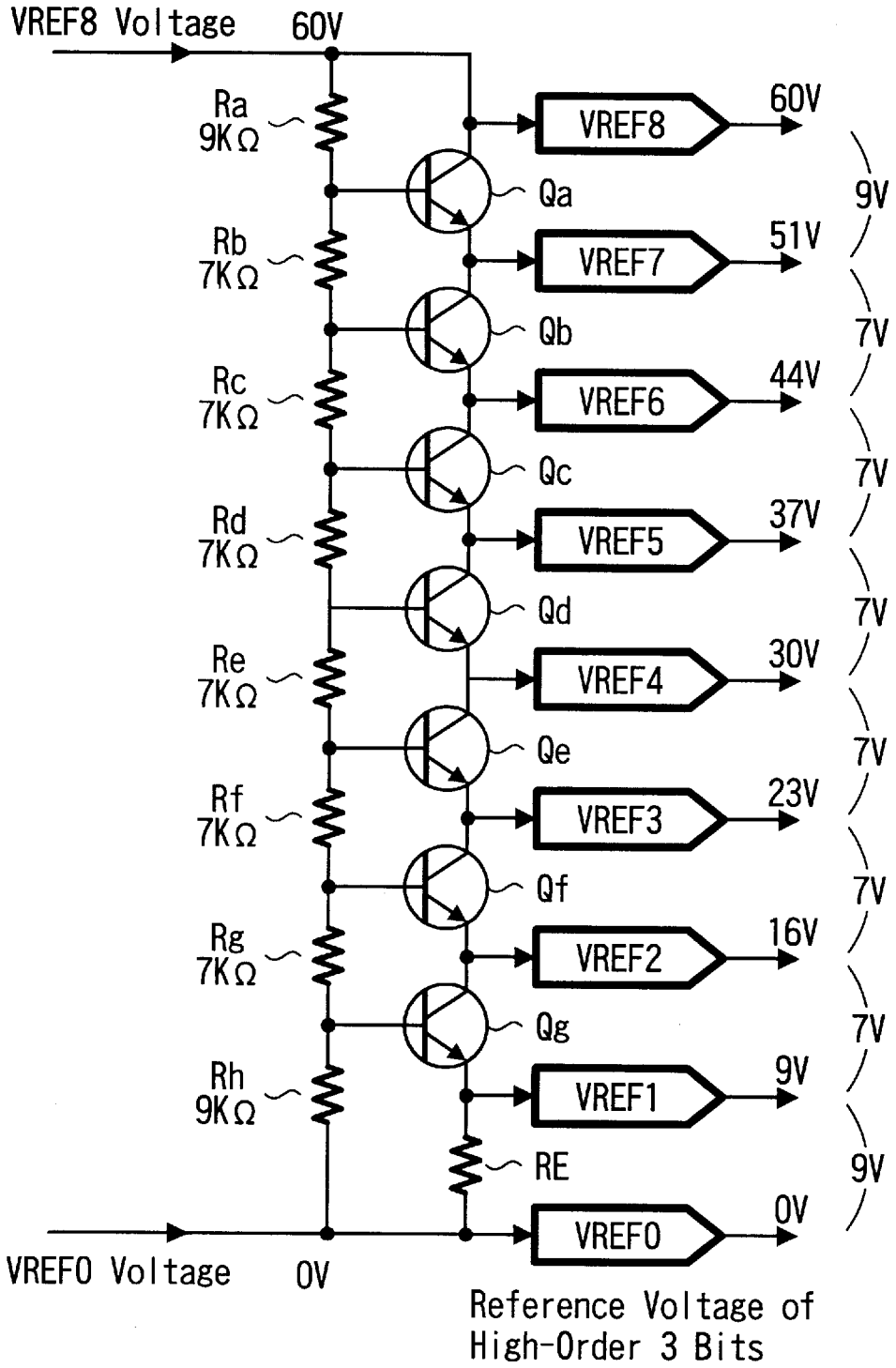
FIG. 11 is a circuit diagram showing a reference voltage generating circuit for the D/A conversion used in the embodiment of the present invention.

Accordingly, in this case, the reference voltage VREF7 (51 V) and the reference voltage VREF6 (44 V) in the reference voltage generating circuit for the D/A converter in FIG. 11 are applied to upper and lower ends of the resistance ladder circuit on the next stage, which is composed of the sixteen resistors R0 through R15 with resistance value R shown in FIG. 10. The 10th voltage {7 V×(10/16)+44} of the sixteen voltages obtained by dividing a voltage of 7V is applied by the switch circuit SL9 to the respective gates of an NMOS transistor 76 and a PMOS transistor 77 of a buffer circuit shown in FIG. 12, and output impedance is lowered in the buffer circuit so that the voltage is applied to the transparent electrodes 13. In the reference voltage generating circuit of FIG. 11, the reference voltage VREF8 (60 V) and the reference voltage VREF0 (0 V) are applied to both ends of a series circuit composed of resistors Ra (9 kΩ), Rb (7 kΩ), Rc (7 kΩ), Rd (7 kΩ), Re (7 kΩ), Rf (7 kΩ), Rg (7 kΩ) and Rh (9 kΩ) which are connected with each other in series, successively from the top to the bottom. Collector-emitters of seven NPN transistors Qa through Qg are connected in series successively, and the reference voltage VREF8 is applied to the collector of the transistor Qa, and the reference voltage VREF0 is applied to the emitter of the transistor Qg via the resistor RE. A base of the transistor Qa is connected with a connection mid-point of the resistors Ra and Rb, and a base of the transistor Qb is connected with a connection mid-point of the resistors Rb and Rc. Such connection is continued until a base of the transistor Qg is finally connected with a connection mid-point of the resistors Rg and Rh. Thereafter, the reference voltage VREF8 (60 V) is obtained at the collector of the transistor Qa, the reference voltage VREF7 (51 V) is obtained at the collector of the transistor Qb, the reference voltage VREF6 (44 V) is obtained at the collector of the transistor Qc, the reference voltage VREF5 (37 V) is obtained at the collector of the transistor Qd, the reference voltage VREF4 (30 V) is obtained at the collector of the transistor Qe, the reference voltage VRTEF3 (23 V) is obtained at the collector of the transistor Qf, the reference voltage VREF2 (16 V) is obtained at the collector of the transistor Qg, and the reference voltage VREF1 (9 V) is obtained at the emitter of the transistor Qg, respectively. The reference voltage VREF0 (0V) is obtained as it is.

In the case where the D/A converter 75 is a 8-bit D/A converter, the image data are divided into a signal of high-order 3 bits and a signal of low-order 5 bits. The signal of low-order 5 bits is supplied to thirty-two decoders so that thirty-two selection signals are obtained. The thirty-two selection signals are supplied to thirty-two switch circuits for selecting thirty-two divided voltages of the resistance ladder circuit composed of the resistors with same resistance value R so that a D/A converting operation is performed in the similar manner to the above one.

Figure 6:
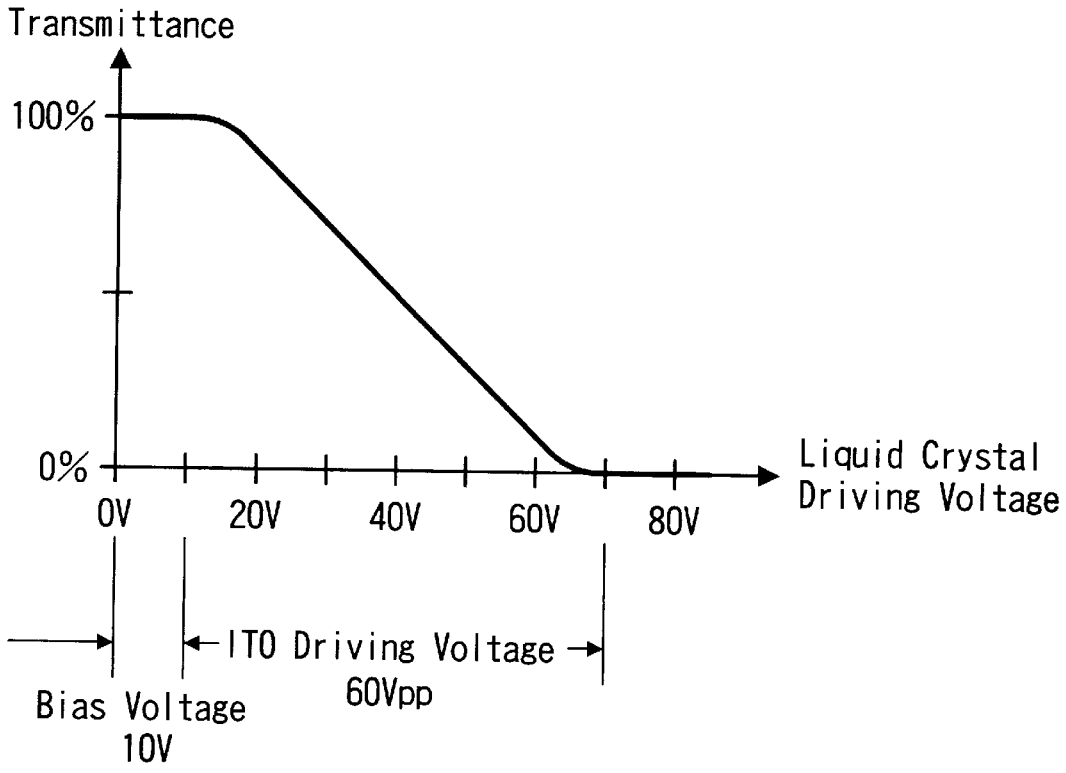
FIG. 6 is a characteristic curve chart showing a driving voltage-transmittance (V-T) characteristic of a liquid crystal device.

Incidentally, as shown in FIG. 6, the characteristic curve of the driving voltage-transmittance (V-T) of the normally white plasma addressed liquid crystal display apparatus is such that when the driving voltage is equal to or less than 10 V, the transmittance is 100%, and when the driving voltage exceeds 10 V, the transmittance is lowered approximately linearly, and when the driving voltage becomes about 70 V, the transmittance becomes 0%. Even if the driving voltage exceeds approximately 70 V, the transmittance is 0%, namely, is saturated with black. Moreover, the driving voltage of the transparent electrodes (ITO) 13 becomes 60 Vpp maximumly.

Therefore, in the case where the anode electrodes 8 are driven directly by an image signal of ±70 V, a driving waveform of about 140 Vpp is required, and thus there arises a problem that a semiconductor process becomes expensive. Furthermore, there arises a problem that the dissipation power is greatly increased. For this reason, a common anode inversion driving system is generally used. FIGS. 21 through 24 show an operating principle of the common anode inversion driving system in a driving system of the conventional display device in FIG. 20.

In the case where a black signal of ±70 V with brightness of 0 IRE is written, as shown in FIG. 21A, an image signal of 60 V is applied directly to the transparent electrodes (ITO) 13 on the positive electrode side (non-inversion side) on a certain line, and as shown in FIG. 21B, a voltage of −10 V is applied to the common electrode, namely the common anode electrodes 8 simultaneously.

It is necessary to write a black signal of −70 V which was inverted due to the inversion driving on the next line, but as shown in FIG. 21A, a black signal of −70 V is converted into an image signal of 0 V, which was obtained by inverting an image signal on the line of 30V mid-point potential and then applied to the transparent electrodes (ITO) 13. At: the same time, while the inverted signal is being applied to the transparent electrodes (ITO) 13, as shown in FIG. 21B, a voltage of +70 V is applied to the common electrode, namely the common anode electrodes 8. Namely, in the case where the electrode potential of the common anode electrode 8s is considered as reference, as shown in FIG. 22, a driving waveform of ±70 V is obtained relatively, and thus this is equivalent to the direct driving of ±70 Vpp described with reference to FIG. 6.

In the case where a white signal of ±70 V with brightness of 100 IRE is written, as shown in FIG. 23A, an image signal of 0 V is applied directly to the transparent electrodes (ITO) 13 on the positive side (non-inversion side) on a certain line, and as shown in FIG. 23B, a voltage of −10 V is applied to the common electrode, namely the common anode electrodes 8 simultaneously. It is necessary to write a white signal of −70 V which was inverted due to the inversion driving on the next line, but as shown in FIG. 23A, a white signal of −70 V is converted into an image signal of 60 V, which was obtained by inverting an image signal on a line of 30V mid-point potential, and then applied to the transparent electrodes (ITO) 13. At the same time, while the inverted signal is being applied to the transparent electrodes (ITO) 13, as shown in FIG. 23B, a voltage of +70 V is applied to the common electrode, namely, the common anode electrodes 8. That is, in the case where the electrode potential of the common anode electrode 8 is considered as reference, as shown in FIG. 24, a driving waveform of ±10 V is obtained relatively, and thus this is equivalent to the direct driving of ±10 Vpp described with reference to FIG. 6.

Figure 20:
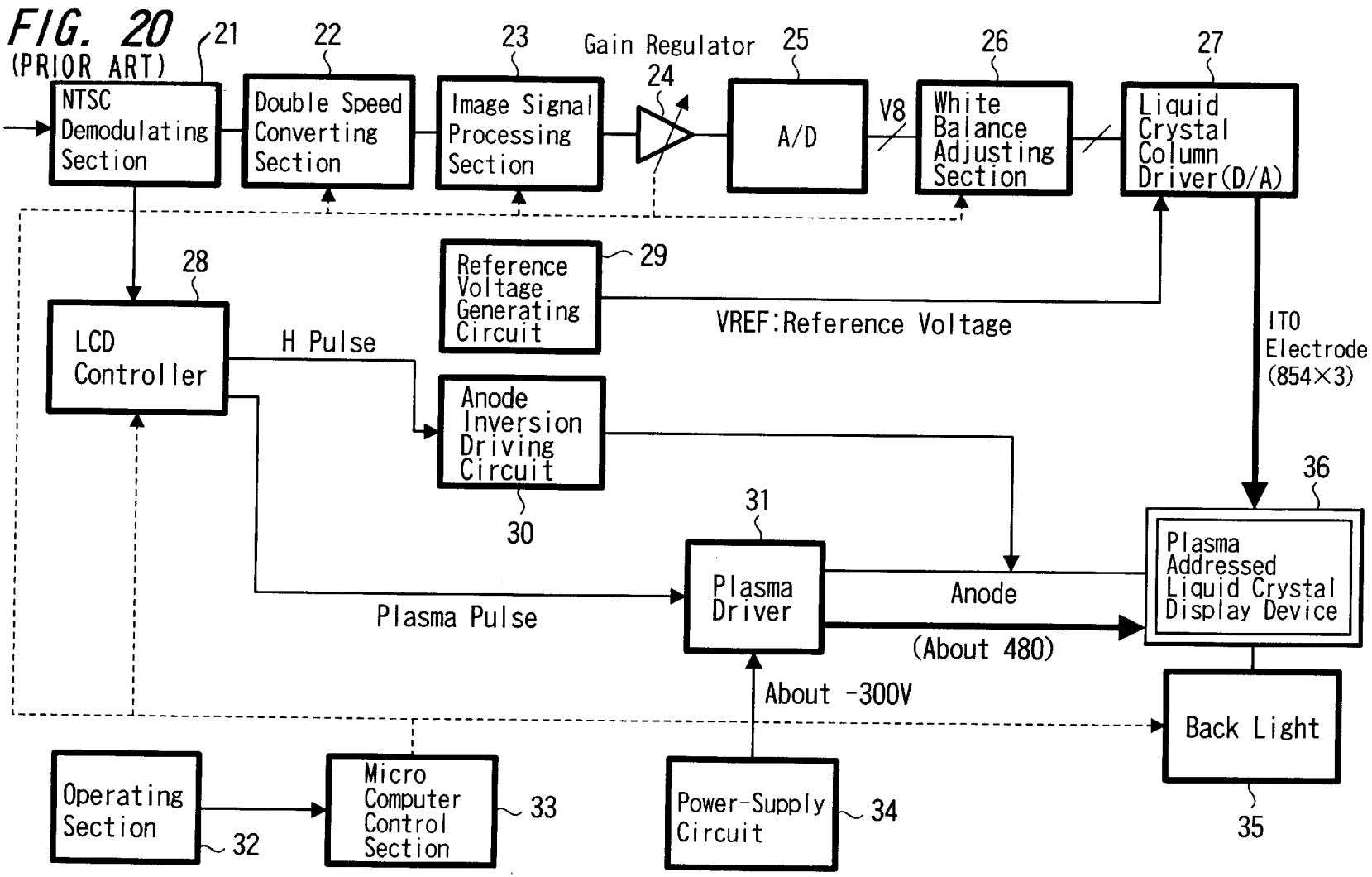
FIG. 20 (PRIOR ART)
FIG. 20 is a block diagram showing a driving apparatus of a plasma addressed liquid crystal display apparatus according to a conventional example.

Incidentally, in the common anode inversion driving system, in the case where the contrast of a white signal with brightness of 100 IRE is reduced to ½, in the driving apparatus of the conventional display device shown in FIG. 20, a level of an image signal is reduced to ½ by the gain regulator 24 on the previous stage of the A/D converter 25 so that, as shown in FIG. 25A, a driving voltage of the transparent electrodes (ITO) 13 is reduced to ½, i.e., 30 V. Here, as shown in FIG. 25B, the anode inversion driving voltage is −10 V on the non-inversion data side and 70 V on the inversion data side. Moreover, as shown in FIG. 26, the actual liquid crystal driving voltage waveform on a basis of the anode voltage is ±40 V driving waveform.

In the conventional system, in the case where the contrast is reduced to ¼ of the minimum value, for example, the signal level of 256 gray scales is reduced to ¼, i.e., 64 gray scales, and thus S/N of a display image is deteriorated.

Therefore, in the present embodiment, in the case where the contrast is reduced to ½, for example, upper and lower reference voltages, which are applied to the reference voltage generating circuit of the reference voltage selection D/A converter in the liquid crystal column driver 27, are reduce to ½ of 120 V and 60 V, i.e., 60 V and 30 V at the time of non-inversion, and are reduced to ½ of 60V and 0V, i.e., 30 V and 0V at the time of inversion by the gain regulator 41 shown in FIG. 1. The output voltage, which is subjected to the D/A conversion by the liquid crystal column driver 27, is reduced to ½ of 60 Vpp, i.e., 30 Vpp.

Figure 18A:
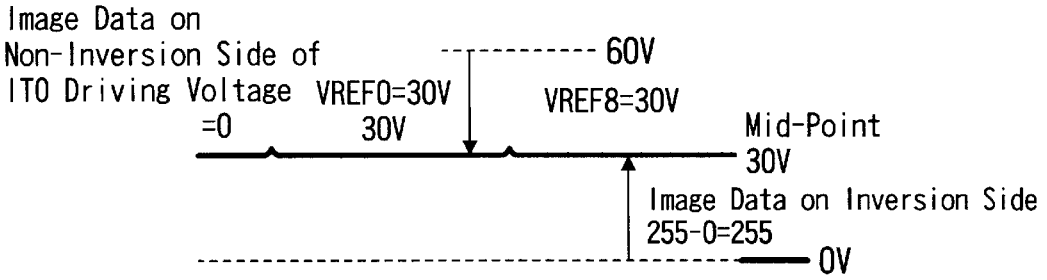
FIG. 18A is a waveform chart showing an ITO driving waveform when a signal has brightness of 100 IRE and ½ (50%) contrast according to the embodiment of the present invention.

As a result, even when the image signal is kept constant maximumly, as shown in FIG. 18A, the driving voltage of the transparent electrodes (ITO) 13 by means of a white signal with brightness of 100 IRE at the time of non-inversion is reduced to ½ of 60 V, i.e., 30V, and as the driving voltage waveform on the next inversion side, the voltage of 30 V is applied.

Figure 17:
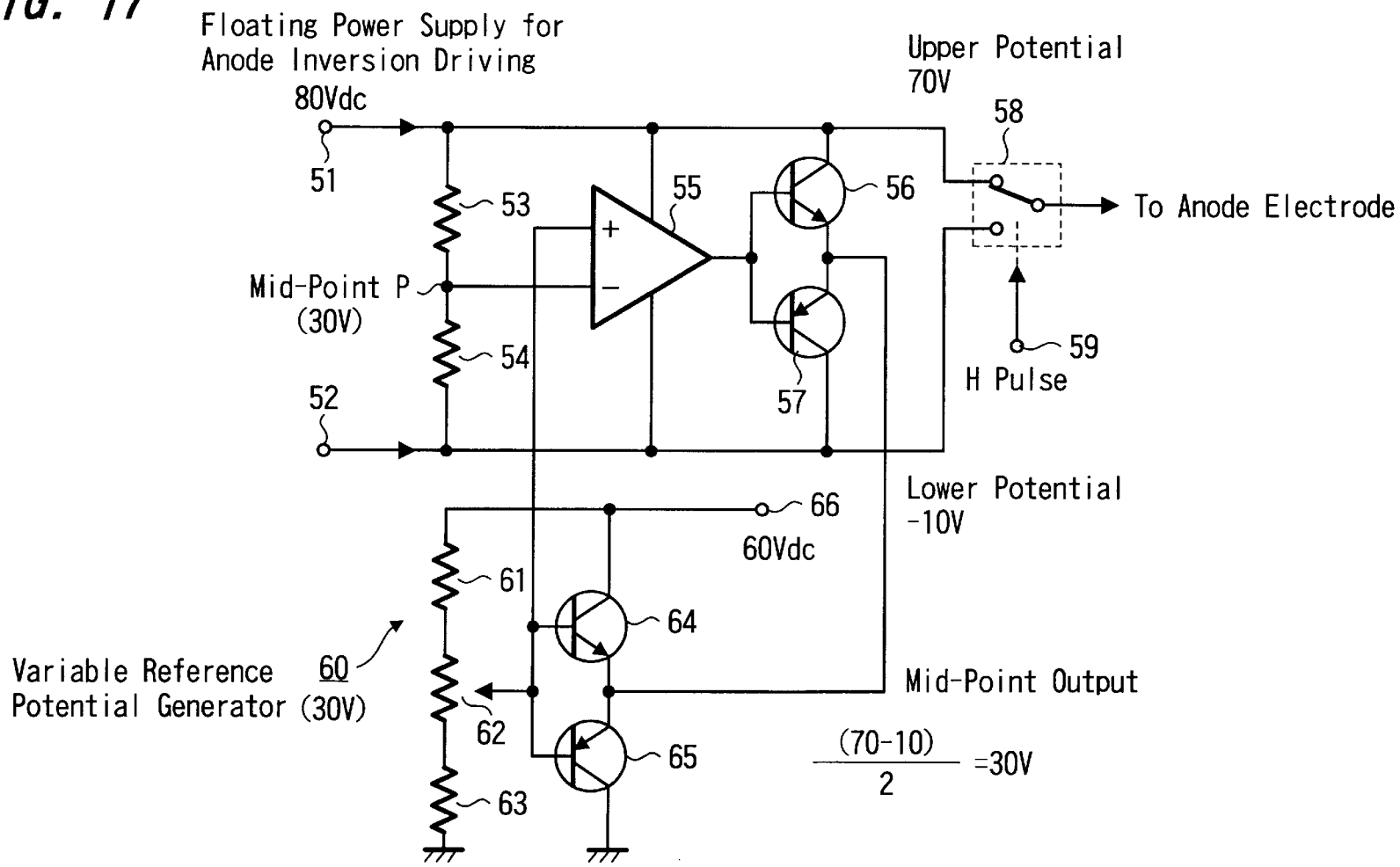
FIG. 17 is a circuit diagram showing a mid-point potential coincidence circuit for generation of upper/lower electric potentials used in the embodiment of the present invention.
Figure 18B:
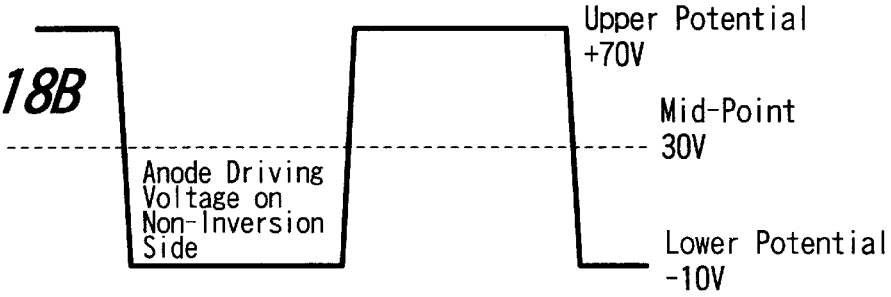
FIG. 18B is a waveform chart showing a driving waveform of the anode electrode when a signal has brightness of 100 IRE and ½ (50%) contrast according to the embodiment of the present invention.

On the other hand, as shown in FIG. 18B, similarly to the conventional system, a voltage whose lower potential is −10 V and upper potential is 70 V is applied in the anode inversion driving circuit 30. Actually, feedback control is made by a mid-point coincidence circuit shown in FIG. 17 so that a mid-point of the power supply for the column driver has the level same as that of a mid-point of upper and lower potentials of the anode inversion driving voltage. As a result, completely symmetrical driving by means of positive and negative voltages can be realized.

There will be described below the mid-point potential coincidence circuit for generating upper/lower side potentials shown in FIG. 17. In the mid-point potential coincidence circuit, a feedback circuit composed of an operational amplifier (OP amplifier) 55 is operated so that the middle point of the power supply for the anode inversion driving coincides with a variable potential of the power supply for the column driver.

Namely, as for the anode inversion driving voltage, a power-supply voltage of 80 Vdc, which is obtained by adding a bias level of 20 V and a power-supply voltage of 60 V with 100% contrast, is defined by the mid-point potential coincidence circuit so that an upper potential is 70 V and lower potential is −10 V symmetrically with respect to the mid-point potential of 30 V. The defined voltage is switched at every 1 horizontal period (H) by an anode inversion switch 58 according to an H pulse supplied from an input terminal 59 and then applied to the anode electrodes.

There will be further described below the mid-point potential coincidence circuit for generating the upper/lower potentials shown in FIG. 17. In a floating power supply for the anode inversion driving, a series circuit of resistors 53 and 54 for voltage dividing, the operational amplifier (OP amplifier) 55 and a series circuit of an NPN transistor 56 and a PNP transistor 57 are connected in parallel between power supply terminals 51 and 52. A connection middle point P of the resistors 53 and 54 is connected to an inversion input terminal of the operational amplifier 55, and its output terminal is connected to bases of the transistors 56 and 57. Voltages from the terminals 51 and 52 are switched at every horizontal period by the anode inversion driving switch 58 according to the H pulses supplied from the input terminal 59, and the switched output voltage is supplied to the anode electrodes.

There will be described below the power supply for the column driver. A series circuit of a fixed resistor 61, a variable resistor (potentiometer) 62 and a resistor 63 composing a variable reference potential generator 60, and a series circuit of an NPN transistor 64 and a PNP transistor 65 are connected in parallel between a terminal 66 to which a DC voltage of 60 Vdc is applied and a ground. A movable terminal of the variable resistor 62 (mid-point potential: 30 V) is connected to the bases of the transistors 64 and 65 and a non-inversion input terminal of the operational amplifier 55 of the floating power supply for anode inversion driving. Moreover, both emitters of the transistors 56 and 57 of the floating power supply for anode inversion driving are connected to both emitters of the transistors 64 and 65 of the column driver power supply.

Figure 15:
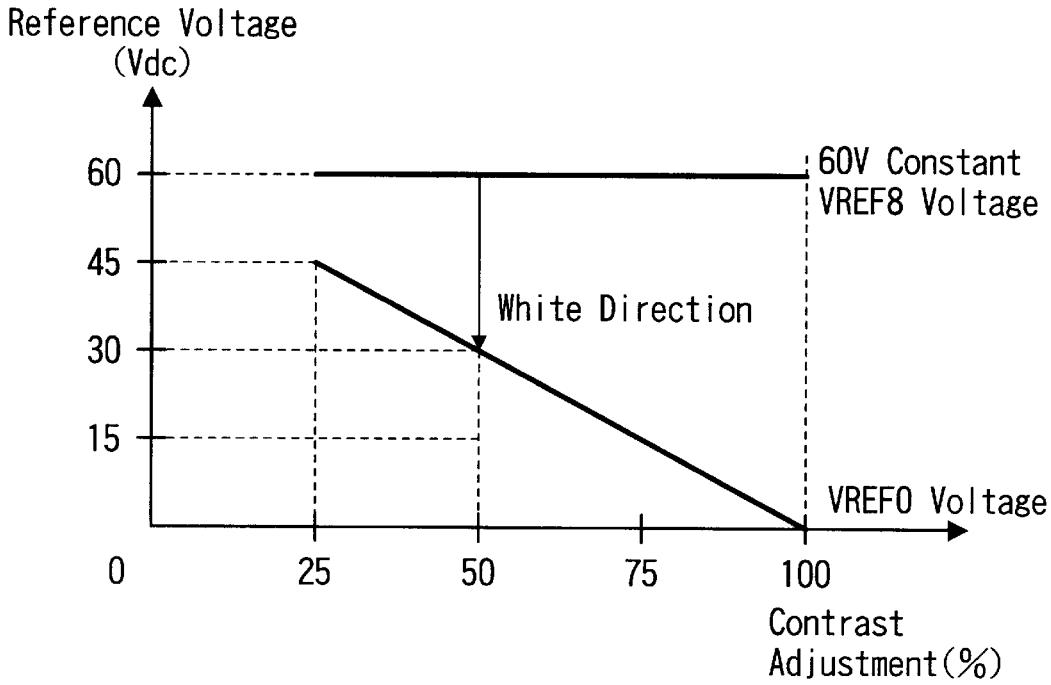
FIG. 15 is a characteristic chart showing non-inversion reference voltage control by means of contrast adjustment according to the embodiment of the present invention.
Figure 16:
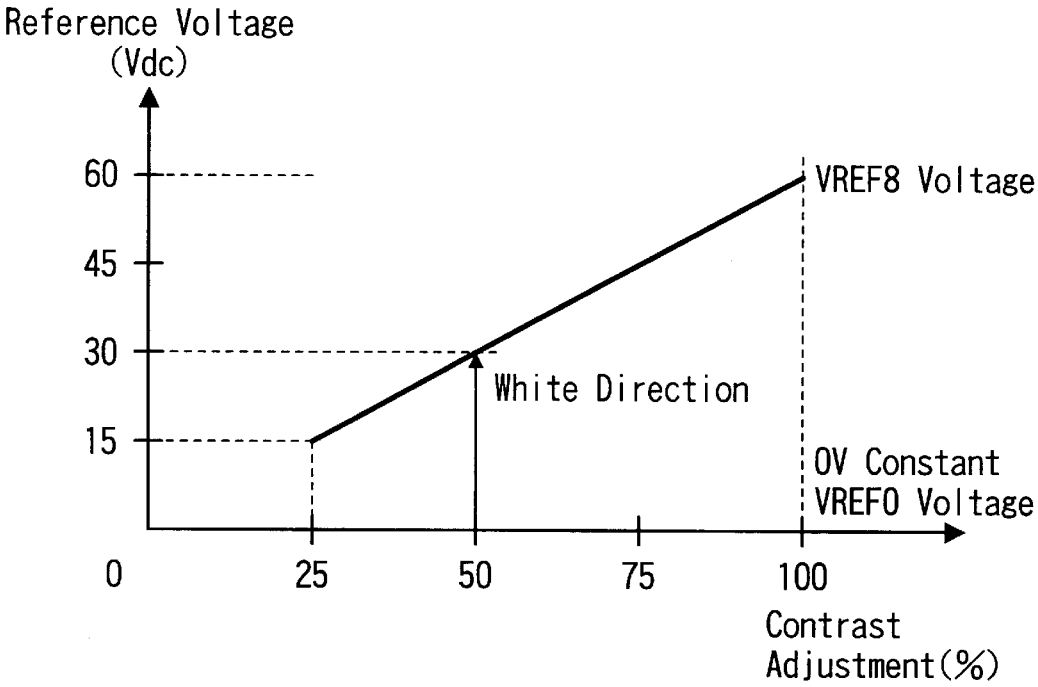
FIG. 16 is a characteristic chart showing the non-inversion reference voltage control by means of contrast adjustment according to the embodiment of the present invention.

Here, in the case where the contrast is lowered, as shown in FIGS. 15 and 16, the reference voltage is changeable so that the driving voltage of the transparent electrodes (ITO) 13 is decreased. FIG. 15 shows a characteristic of the reference voltage control on the non-inversion side by means of the contrast adjustment. When the contrast adjustment is 25%, the reference voltage is 45 V, while when the contrast adjustment is 100%, the reference voltage is 0 V. FIG. 15 shows a characteristic of the reference voltage control on the inversion side by means of the contrast adjustment. When the contrast adjustment is 25%, the reference voltage is 15 V, while when the contrast adjustment is 100%, the reference voltage is 60 V.

Figure 14:
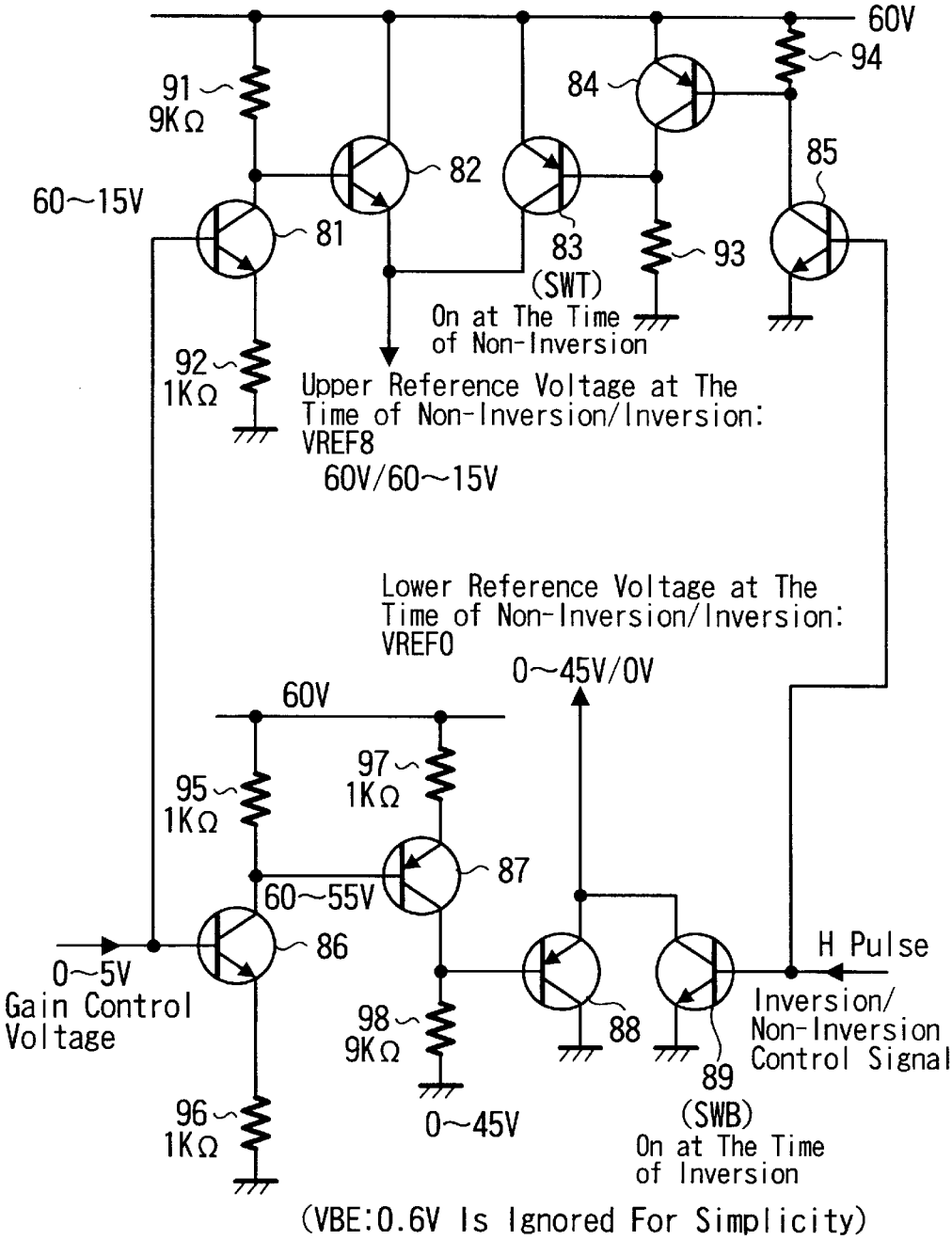
FIG. 14 is a circuit diagram showing a reference voltage switching circuit used in the embodiment of the present invention.

FIG. 14 shows a concrete configuration of the reference voltage switching circuit 42 in FIG. 1. In this circuit, a required reference voltage is generated by the driving voltage of the transparent electrodes (ITO) 13 at the time of non-inversion and inversion. A collector of an NPN transistor 81 where a gain control voltage (0 to 5 V) is applied to its base is connected to a power supply of 60 V via a resistor (9 kΩ) 91, and its emitter is grounded via a resistor (1 kΩ) 92. The collector of the transistor 81 is connected to a base of an NPN transistor 82, and a collector of the transistor 82 is connected to the power supply. Moreover, an emitter of the transistor 82 is connected to a collector of a PNP transistor 83 (SWT), and an emitter of the transistor 83 is connected to the power supply. A base of the transistor 83 is connected to a collector of a PNP transistor 84, and an emitter of the transistor 84 is connected to the power supply, and a collector of the transistor 84 is grounded via a resistor 93. A base of the transistor 84 is connected to a collector of an NPN transistor 85, and the collector of the transistor 85 is connected to the power supply via a resistor 94, and an emitter of the transistor 85 is grounded. An H pulse as an inversion/non-inversion control signal is supplied to a base of the transistor 85. The transistor 83 (SWT) is turned on at the time of non-inversion. Moreover, the upper reference voltage (VREF8) (60 V/60 to 15 V) at non-inversion/inversion is outputted from the emitter of the transistor 82 (collector of the transistor 83).

In FIG. 14, a collector of an NPN transistor 86, where the gain control voltage (0 to 5 V) is supplied to its base, is connected to the power source of 60 V via a resistor (1 kΩ) 95, and its emitter is grounded via a resistor (1 kΩ) 96. A collector of a transistor 86 is connected to a base of a PNP transistor 87, and an emitter of the transistor 87 is connected to the power supply via a resistor (1 kΩ) 97, and its collector is grounded via a resistor (9 kΩ) 98. A collector of the transistor 87 is connected to a base of a PNP transistor 88, and a collector of the transistor 88 is grounded, and its emitter is connected with a collector of an NPN transistor 89 (SWB). An emitter of the transistor 89 is grounded, and an H pulse as an inversion/non-inversion control signal is supplied to its base. The transistor 89 (SWB) is turned on at the time of inversion. A lower reference voltage (VREF0) (0 to 45 V/0 V) at the time of non-inversion/inversion is outputted from the emitter of the transistor 88 (collector of the transistor 89).

Further, a description will be given with reference to FIG. 14. As for the reference voltage at the time of non-inversion, the H pulse becomes 0 V and the transistor 89 (SWB) is turned off. For this reason, the lower reference voltage VREF0 is changed within a range of 0 V to 45 V due to a gain control voltage of 0 to 5 V, and since the transistor 83 (SWT) is ON, the upper reference voltage VREF 8 is kept constant, i.e. 60 V.

In addition, as for the reference voltage at the time of inversion, the H pulse becomes "high", and the transistor 83 (SWT) is OFF. For this reason, the upper reference voltage VREF8 is changed within a range of 60 V to 15 V due to a gain control voltage of 0 to 5 V similarly, and since the transistor 89 (SWB) is ON, the lower reference voltage VREF0 is kept constant, i.e., 0 V.

Figure 19:
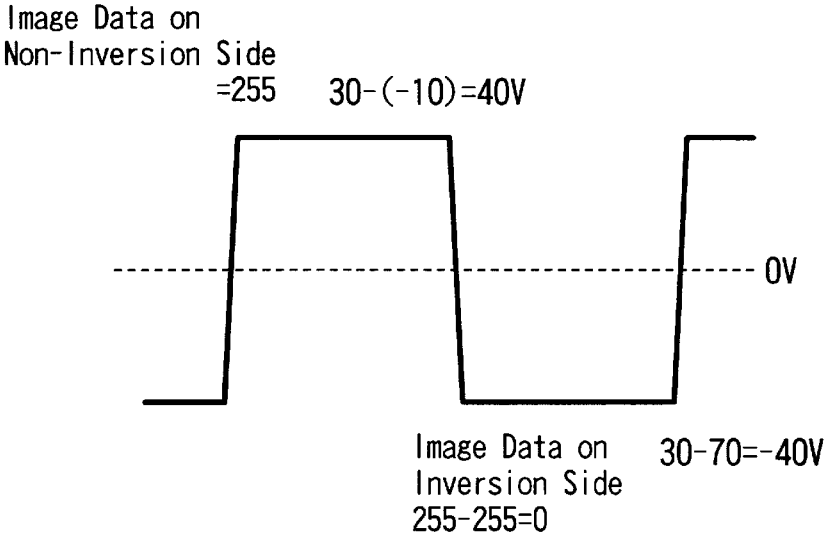
FIG. 19 is a waveform chart showing a driving voltage waveform when an anode electric potential is standardized according to the embodiment of the present invention.

Therefore, in the case where a signal with brightness of 100 IRE is set so that its contrast is reduced ½ (50%), as shown in FIG. 19, a liquid crystal driving voltage where the anode potential is standardized obtains a driving waveform of ±40 V in the positive and negative directions, and the contrast can be reduced to ½ (50%) with the resolution of 256 gray scales being maintained.

The above embodiment is described on the normally white plasma addressed liquid crystal display apparatus, but the normally black plasma addressed liquid crystal display apparatus can be applied. In this case, the relationship between the driving voltages of a white signal and a black signal is reversed, but similarly to the case of the normally white plasma addressed liquid crystal display apparatus, the contrast adjustment can be made.

According to the embodiment of the present invention, when a driving voltage is reduced by decreasing an image signal itself, a number of gray scales of quantization is reduced so that S/N of a display image is changed. However, in the case where the reference voltage selection D/A converter is used, for example, the contrast adjustment is made by using the reference voltage variable circuit and its switching circuit. As a result, the contrast can be adjusted with a number of gray scales of the display image signal being kept constant, and thus the problem of a deterioration in S/N of the display image can be solved.

According to the above invention, in the plasma addressed liquid crystal display apparatus which is provided with a first transparent scanning electrode group arranged on a first surface of a liquid crystal display apparatus, and a second scanning electrode group arranged so as to oppose a second surface of the liquid crystal display apparatus and to form a plurality of plasma discharge channels in a direction perpendicularly to the first scanning electrode group, the driving apparatus of the plasma addressed liquid crystal display apparatus comprises a reference voltage selection D/A converter for applying a driving voltage to the first scanning electrode group; a common anode inversion driving voltage generating means for applying a common anode inversion driving voltage obtained by relatively inverting a driving voltage to the second scanning electrode group; and a contrast reduction adjusting means for simultaneously tracking a voltage on a low voltage side when a reference voltage is not inverted in the reference voltage selection D/A converter and a power-supply voltage on a high voltage side at the time of inversion and increasing/decreasing the voltages so as to adjust reduction in contrast. As a result, the driving apparatus of the plasma addressed liquid crystal display apparatus, where even when the contrast of the display screen is reduced, the S/N is not deteriorated, can be obtained.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A driving apparatus of a plasma addressed liquid crystal display apparatus with a first transparent scanning electrode group arranged on a first surface of a liquid crystal display apparatus, and a second scanning electrode group opposing a second surface of the liquid crystal display apparatus and forming a plurality of plasma discharge channels arranged perpendicular to the first scanning electrode group, the driving apparatus of the plasma addressed liquid crystal display apparatus comprising:

a reference voltage selection digital-to-analog converter for applying a driving voltage to the first scanning electrode group;

common anode inversion driving voltage generating means for applying a common anode inversion driving voltage, obtained by inverting the driving voltage, to the second scanning electrode group; and contrast reduction adjusting means for simultaneously tracking a voltage on a low voltage circuit when a reference voltage is not inverted in the reference voltage selection digital-to-analog converter and a power-supply voltage on a high voltage circuit at a time of inverting the driving voltage and adjusting the voltage on the low voltage circuit and the power-supply voltage to adjust a picture contrast.

* * * * *